US008581823B2

(12) United States Patent
Min et al.

(10) Patent No.: US 8,581,823 B2
(45) Date of Patent: Nov. 12, 2013

(54) LIQUID CRYSTAL DISPLAY DEVICE AND DRIVING METHOD THEREOF

(75) Inventors: Woong Ki Min, Daegu-si (KR); Yong Gi Son, Miryang-si (KR); Su Hyuk Jang, Daegu-si (KR)

(73) Assignee: LG Display Co., Ltd., Seoul (KR)

( * ) Notice: Subject to any disclaimer, the term of this patent is extended or adjusted under 35 U.S.C. 154(b) by 873 days.

(21) Appl. No.: 12/314,912

(22) Filed: Dec. 18, 2008

(65) Prior Publication Data

US 2009/0174642 A1 Jul. 9, 2009

(30) Foreign Application Priority Data

Dec. 28, 2007 (KR) ..... 10-2007-0140497

(51) Int. Cl.
*G09G 3/36* (2006.01)

(52) U.S. Cl.
USPC ..... 345/96

(58) Field of Classification Search
USPC ..... 345/87–100, 204, 209, 54
See application file for complete search history.

(56) References Cited

U.S. PATENT DOCUMENTS

| | | | | |
|---|---|---|---|---|
| 6,075,505 | A * | 6/2000 | Shiba et al. | 345/87 |
| 6,184,853 | B1 * | 2/2001 | Hebiguchi et al. | 345/88 |
| 6,342,876 | B1 | 1/2002 | Kim | |
| 2004/0178981 | A1 * | 9/2004 | Asada et al. | 345/96 |
| 2005/0093806 | A1 | 5/2005 | Hosotani | |
| 2006/0044292 | A1 * | 3/2006 | Shen et al. | 345/204 |
| 2007/0001965 | A1 | 1/2007 | Lee | |
| 2007/0165149 | A1 | 7/2007 | Kim et al. | |
| 2008/0170025 | A1 * | 7/2008 | Song et al. | 345/96 |

FOREIGN PATENT DOCUMENTS

| | | |
|---|---|---|
| EP | 1 826 746 | 8/2007 |
| JP | 2002-032051 A | 1/2002 |
| JP | 2005-140891 A | 6/2005 |
| JP | 2006-106062 A | 4/2006 |

* cited by examiner

*Primary Examiner* — Liliana Cerullo
(74) *Attorney, Agent, or Firm* — McKenna Long & Aldridge LLP

(57) ABSTRACT

A liquid crystal display (LCD) device and a driving method can produce reduced direct current image sticking and flicker. An LCD panel for the LCD device has liquid crystal cells having a common same color in each horizontal line and has columns of liquid crystal cells having a repeating sequence of color, a timing controller for generating a polarity control signal such that the polarity control signal is varied at intervals of one frame period, a data driving circuit supplying data voltages to the data lines in response to the polarity control signal, and a gate driving circuit supplying scan pulses to the gate lines. The liquid crystal cells include first liquid crystal cell groups supplied with data voltages having polarities inverted from polarities the previous frame period, and second liquid crystal cell groups supplied with data voltages having polarities identical to the polarities supplied in the previous frame period.

19 Claims, 23 Drawing Sheets

LIQUID CRYSTAL DISPLAY DEVICE AND DRIVING METHOD THEREOF

This application claims the benefit of the Korean Patent Application No. 10-2007-140497, filed on Dec. 28, 2007, which is hereby incorporated by reference for all purposes as if fully set forth herein.

BACKGROUND OF THE INVENTION

1. Field of the Invention

The present invention relates to a liquid crystal display (LCD) device, and more particularly, to an LCD device and a driving method thereof.

2. Discussion of the Related Art

Liquid crystal display (LCD) devices display an image by controlling the light transmittance of liquid crystal cells in accordance with a video signal. In an active matrix type LCD device such as the one illustrated in FIG. 1, data voltages to be supplied to liquid crystal cells Clc, are switched by thin film transistors (TFTs) formed in respective liquid crystal cells Clc. The TFTs provide active control of the data voltages to achieve an enhancement in the display quality of a moving image.

In FIG. 1, the reference character "Cst" designates a storage capacitor that maintains the data voltage charged in the associated liquid crystal cell Clc, the reference character "D1" designates a data line supplied with the data voltage, and the reference character "G1" designates a gate line supplied with a scan pulse.

A LCD display device having liquid crystal cells as illustrated in FIG. 1 may be driven in accordance with an inversion scheme, in which polarity inversion not only occurs between neighboring liquid crystal cells, but also occurs at intervals of one frame, as shown in FIG. 2, to reduce DC offset components supplied to the liquid crystal cells and to thus reduce degradation of the liquid crystals. When any one of data voltages having opposite polarities is, however, dominantly supplied for a prolonged period of time, image sticking may occur. Such image sticking is called "DC image sticking" because the image sticking occurs as each liquid crystal cell is repeatedly charged with voltages having the same polarity. As an example, such image sticking can occur when data voltages are supplied to the LCD device in accordance with an interlace scheme. The interlace scheme for supplying data includes supplying data voltages to liquid crystal cells on odd horizontal lines in odd frame periods, and supplying data voltages to liquid crystal cells on even horizontal lines in even frame periods. Data supplied in accordance with the interlace scheme is referred to hereinafter as "interlace data".

FIG. 3 is a waveform diagram that shows an example of interlace data supplied to a liquid crystal cell Clc. In the illustrated example, it is assumed that the liquid crystal cell Clc supplied with the data voltages depicted in FIG. 3 is one of the liquid crystal cells arranged on one odd horizontal line.

Referring to FIG. 3, a positive voltage is supplied to the liquid crystal cell Clc in odd frame periods, and a negative voltage is supplied to the liquid crystal cell Clc in even frame periods. In accordance with the interlace scheme, a data voltage having a high positive polarity level is supplied to liquid crystal cells Clc arranged on odd horizontal lines only in odd frame periods. For this reason, the positive data voltage becomes dominant during 4 frame periods, as compared to the negative voltage, as shown by the waveform in the box of FIG. 3.

FIG. 4 is an image showing the experimental results of DC image sticking occurring due to interlace data. When an original image corresponding to the left image in FIG. 4 is supplied to an LCD panel for a certain period of time in accordance with the interlace scheme, the data voltage, which is varied in polarity at intervals of one frame, exhibits a considerable amplitude difference between the odd frame and the even frame. As a result, when a data voltage having an intermediate grayscale value, for example, a grayscale value of 127, is supplied to all liquid crystal cells Clc of the LCD panel, after the supply of the original image, the pattern of the original image is dimly displayed, as shown by the right image in FIG. 3. That is, DC image sticking occurs.

The moving image display quality of the LCD device may be degraded not only due to DC image sticking, but also due to flicker. Flicker is a periodic brightness difference visible to a viewer's naked eye. Therefore, it is desirable to reduce or eliminate DC image sticking and flicker to enhance the display quality of the LCD device.

SUMMARY OF THE INVENTION

Accordingly, the present invention is directed to a liquid crystal display device and a driving method thereof that substantially obviate one or more problems due to limitations and disadvantages of the related art.

An advantage of the present invention is to provide a liquid crystal display device and a driving method thereof, which are capable of preventing or reducing direct current (DC) image sticking and flicker, thereby achieving an enhancement in display quality.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the invention, as embodied and broadly described herein, a liquid crystal display device includes: a liquid crystal display panel having a plurality of data lines supplied with data voltages, a plurality of gate lines supplied with scan pulses, wherein a plurality of liquid crystal cells on the liquid crystal display panel are each configured to display one of a plurality of colors, wherein liquid crystal cells arranged in a horizontal line along a gate line direction are configured to display a common color, and wherein liquid crystal cells arranged in each column along a direction of the data lines are arranged to display a repeating sequence of the plurality of colors; a timing controller for generating a polarity control signal having a sequence of polarity levels that vary at intervals of one frame period; a data driving circuit for supplying the data voltages to the data lines having a polarity in response to the polarity control signal; and a gate driving circuit for supplying the scan pulses to the gate lines, wherein the liquid crystal cells are coupled to the data lines and gate lines to receive the data voltages and the gate pulses so that the liquid crystal cells of the liquid crystal display panel are driven in groups, the groups including first liquid crystal cell groups driven so that the data voltages in a frame period have polarities inverted from polarities in an immediately prior frame period, and second liquid crystal cell groups driven so that the data voltages in a frame period have polarities identical to the polarities in an immediately prior frame period, and the first and second liquid crystal cell groups are alternately arranged in a vertical direction at intervals of two horizontal lines, and wherein the positions of the first liquid crystal cell groups alternate with the positions of the second liquid crystal cell groups at intervals of one frame period.

In another aspect of the present invention, a method for driving a liquid crystal display device including a liquid crystal display panel formed with a plurality of data lines, to which data voltages are supplied, and a plurality of gate lines, to which scan pulses are supplied, the liquid crystal display panel having a plurality of liquid crystal cells each configured to display one of a plurality of colors, wherein liquid crystal cells arranged in a horizontal line along a gate line direction are configured to display a common color and wherein liquid crystal cells arranged in each column along a direction of the data lines are arranged to display a repeating sequence of the plurality of colors, the method including: generating a polarity control signal such that the polarity control signal has a sequence of polarity levels that vary at intervals of one frame period; supplying the scan pulses to the gate lines; and supplying data voltages to the liquid crystal cells using the data lines including: supplying the data voltages in a frame period, which have polarities inverted from polarities in an immediately previous frame period, to first liquid crystal cell groups of the liquid crystal cells; and supplying the data voltages in the frame period, which have polarities identical to the polarities in the immediately previous frame period, to second liquid crystal cell groups of the liquid crystal cells in a simultaneous manner, in response to the polarity control signal, wherein the first and second liquid crystal cell groups are alternately arranged in a vertical direction at intervals of two horizontal lines, and wherein the positions of the first liquid crystal cell groups alternate with the positions of the second liquid crystal cell groups at intervals of one frame period.

The first liquid crystal groups may be driven at a data driving frequency higher than a data driving frequency for driving the second liquid crystal groups.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
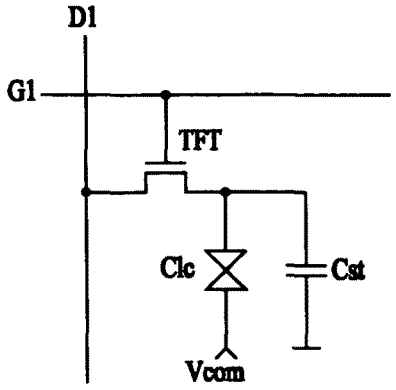
FIG. 1 Related Art
FIG. 1 is an equivalent circuit diagram schematically illustrating one liquid crystal cell of a related art liquid crystal display (LCD) device.
Figure 2:
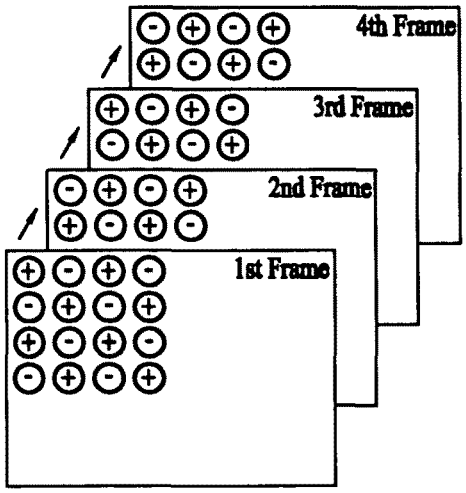
FIG. 2 Related Art
FIG. 2 is a schematic view illustrating the polarity patterns of data voltages supplied to a LCD panel of the related art for different frames.
Figure 3:
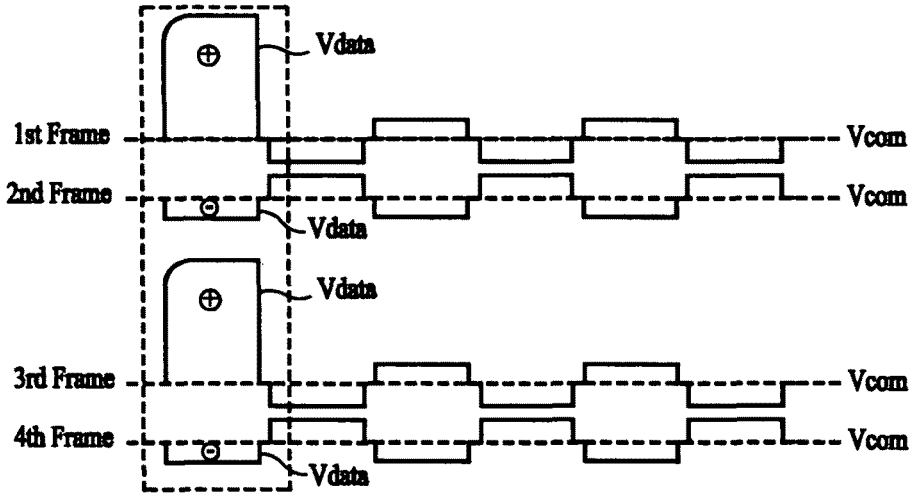
FIG. 3 Related Art
FIG. 3 is a waveform diagram of an example of interlace data.
Figure 4:
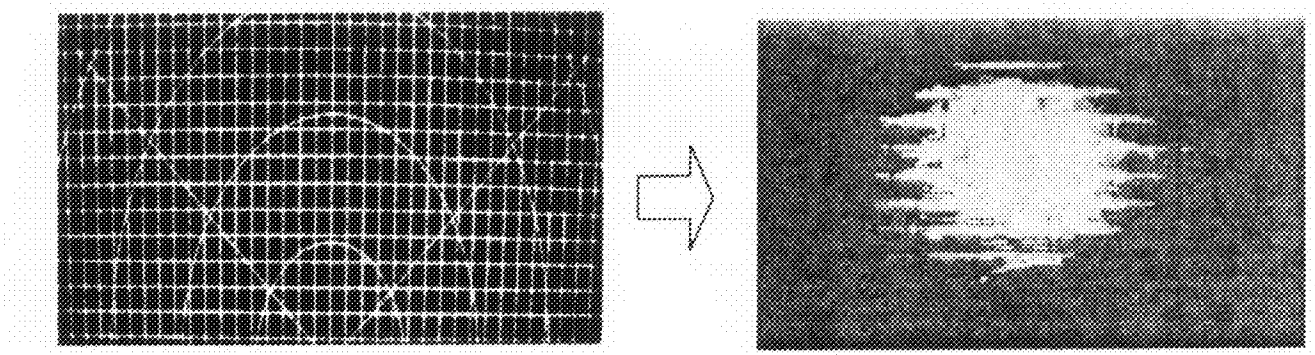
FIG. 4 Related Art
FIG. 4 is an image displayed on a screen, showing the experimental results of DC image sticking occurring due to interlace data.
Figure 5:
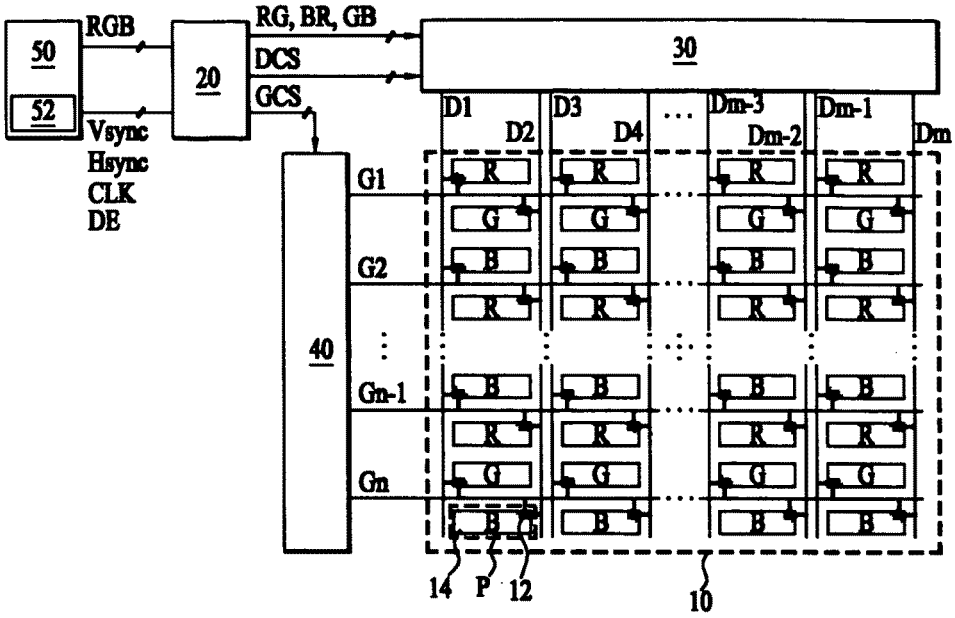
FIG. 5 is a block diagram illustrating an LCD device according to a first embodiment of the present invention.

FIG. 5 is a block diagram schematically illustrating a liquid crystal display (LCD) device according to an exemplary embodiment of the present invention.

Referring to FIG. 5, the LCD device according to the illustrated embodiment of the present invention includes an LCD panel 10, a timing controller 20, a data driving circuit 30, and a gate driving circuit 40.

The LCD panel 10 includes two glass substrates, between which a liquid crystal layer is formed. The LCD panel 10 also includes liquid crystal cells P formed in regions defined by crossings of a plurality of data lines D1 to Dm with a plurality of gate lines G1 to Gn such that the liquid crystal cells P are arranged along horizontal lines and vertical lines.

Each liquid crystal cell P includes a thin film transistor (TFT) 12, and a pixel electrode 14 coupled to the TFT 12. The TFTs 12 of the liquid crystal cells P arranged on each vertical line are coupled to one of the gate lines G1 to Gn, and are alternately coupled to two of the data lines D1 to Dm. Each liquid crystal cell P further includes a liquid crystal capacitor Clc formed by the liquid crystal layer between the pixel electrode 14 and a common electrode (not shown), and a storage capacitor formed by overlap of the pixel electrode 14 with the common electrode or with an adjacent gate line.

The TFTs 12 of the liquid crystal cells P arranged along each odd one of the horizontal lines are commonly coupled to a corresponding one of the gate lines G1 to Gn, and are coupled to respective odd data lines D1, D3, . . . , Dm−1. The TFTs 12 of the liquid crystal cells P arranged on each even one of the horizontal lines are commonly coupled to a corresponding one of the gate lines G1 to Gn, and are coupled to respective even data lines D2, D4, . . . , Dm. On the other hand, two liquid crystal cells P are arranged in a vertical direction between adjacent pairs of gate lines G1 to Gn, one liquid crystal cell P is arranged in a horizontal direction between a pair of data lines D1 and D2, and another liquid crystal cell P is arranged in a horizontal direction between a pair of data lines D3 and D4. But, liquid crystal cells P are not arranged between the pair of data lines D1-D2 and the pair of data lines D3-D4

The pixel electrode 14 of each liquid crystal cell P has a rectangular structure having longer sides extending along a direction parallel to the gate lines G1 to Gn and shorter sides extending along a direction parallel to the data lines D1 to Dm. The pixel electrode 14 may be formed to have a structure including no extension portion, a parallel structure including one or more uniformly-spaced bent or curved extension portions, or a parallel structure having one or more uniformly-spaced straight extension portions.

Each liquid crystal capacitor generates an electric field in accordance with a voltage difference between a data voltage supplied to the pixel electrode 14 and a common voltage supplied to the common electrode, to drive liquid crystals. The storage capacitor stores the voltage difference between the data voltage and the common voltage, to enable the voltage stored in the liquid crystal capacitor to be maintained even after the TFT 12 is turned off.

Three liquid crystal cells P arranged adjacent to one another in a vertical direction constitute one unit pixel. The liquid crystal cells P in a horizontal line have the same color, while the liquid crystal cells in a common vertical line vary in color. That is, the "3i+1"th horizontal line ("i" is a positive integer) includes liquid crystal cells P having a first color of red (R), green (G), and blue (B), for example, red. The "3i+2"th horizontal line includes liquid crystal cells P having a second color of red (R), green (G), and blue (B), for example, green. The "3i+3"th horizontal line includes liquid crystal cells P having a third color of red (R), green (G), and blue (B), for example, blue. In the above described example, the liquid crystal cells in a column of would be arranged in repeating sequence including in order a red (R), green (G), and blue (B) liquid crystal cell P.

The timing controller 20 receives timing signals, for example, vertical and horizontal synchronizing signals Vsync and Hsync, a data enable signal DE, and a clock signal CLK, and generates timing control signals to control the operation timings of the data driving circuit 30 and gate driving circuit 40, based on the received timing signals. The timing control signals include gate control signals GCS such as a gate start pulse GSP, a gate shift clock signal GSC, and a gate output enable signal GOE. The timing control signals also include data control signals DCS such as a source start pulse SSP, a source sampling clock SSC, a source output enable signal SOE, and a polarity control signal POL.

The gate start pulse GSP is a timing control signal indicating a first scan pulse to be supplied to a start horizontal line, from which a scanning operation starts in one vertical period for displaying one frame, namely, a first gate line. The gate shift clock signal GSC is a timing control signal, which is input to shift registers included in the gate driving circuit 40, to sequentially shift the gate start pulse GSP. The source start pulse SSP indicates a start pixel on one horizontal line to display data. The source sampling clock SSC enables a data latch operation of the data driving circuit 30 based on a rising or falling edge. The source output enable signal SOE enables an output from the data driving circuit 30. The polarity control signal POL indicates the polarity of a data voltage to be supplied to the liquid crystal cells of the LCD panel 10.

Figure 6:
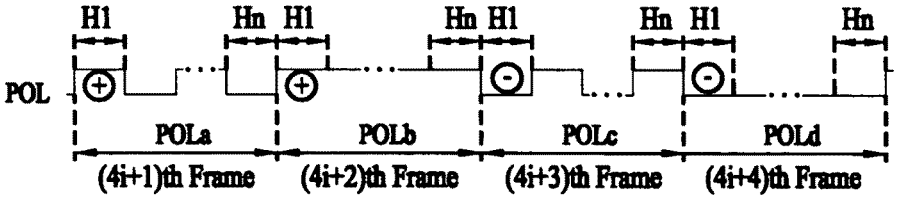
FIG. 6 is a waveform diagram depicting a polarity control signal according to the first embodiment of the present invention.

The timing controller 20 generates polarity control signals POL having a sequence of different logic levels at intervals of 4 frames, and supplies the generated polarity control signals POL to the data driving circuit 30. That is, as shown in FIG. 6, the timing controller 20 supplies a first polarity control signal POLa to the data driving circuit 30, for a "4i+1"th frame. The first polarity control signal POLa has a level that changes between a high level H and a low level L or between a low level L and a high level H at intervals of one horizontal period (two horizontal lines). For a "4i+2"th frame, the timing controller 20 supplies a second polarity control signal POLb to the data driving circuit 30. The second polarity control signal POLb has a level maintained at the high level H. For a "4i+3"th frame, the timing controller 20 supplies a third polarity control signal POLc to the data driving circuit 30. The third polarity control signal POLc has a waveform inverted from that of the first polarity control signal POLa. For a "4i+4"th frame, the timing controller 20 supplies a fourth polarity control signal POLd to the data driving circuit 30. The fourth polarity control signal POLd has a waveform inverted from that of the second polarity control signal POLb.

The timing controller 20 may generate the timing control signals for the driving circuits on the basis of a frame frequency of 120 Hz or 60 Hz, to control the operation timings of the data driving circuit 30 and gate driving circuit 40 at a frequency determined on the basis of the frame frequency of 120 Hz or 60 Hz. The frame frequency is a frequency corresponding to the vertical synchronizing signal Vsync. This frame frequency indicates the number of frames per second. For example, at a frame frequency of 120 Hz, 120 frames per second are displayed on the LCD panel 10. At a frame frequency of 60 Hz, 60 frames per second are displayed on the LCD panel 10. When the LCD device is driven at the frame frequency of 120 Hz, the viewer can see no or little flicker, as compared to the driving at the frame frequency of 60 Hz. To this end, it is desirable to generate control signals on the basis of the frame frequency of 120 Hz, in order to enhance the effect of preventing flicker.

The timing controller 20 arranges input digital video data RGB such that the input digital video data RGB corresponds to the arrangement structure of the liquid crystal cells P formed on each horizontal line of the LCD panel 10. The timing controller 20 supplies the arranged digital video data RGB to the data driving circuit 30. That is, for the arrangement illustrated in FIG. 5, the timing controller 20, which sequentially receives input digital video data RGB in the unit of one horizontal line, arranges red (R) and green (G) data of a first one-horizontal-line input digital video data RGB as data RG for a "3i+1"th horizontal line, and supplies the arranged data RG to the data driving circuit 30. The timing controller 20 then arranges the remaining blue (B) data of the first one-horizontal-line input digital video data RGB and red (R) data of a second one-horizontal-line input digital video data RGB as data BR for a "3i+2"th horizontal line, and supplies the arranged data BR to the data driving circuit 30. Subsequently, The timing controller 20 arranges the remaining green (G) and blue (B) data of the second one-horizontal-line input digital video data RGB as data GB for a "3i+3"th horizontal line, and supplies the arranged data GB to the data driving circuit 30.

The data driving circuit 30 latches the data RG, BR, or GB for each one horizontal line input from the timing controller 20, under the control of the timing controller 20. The data driving circuit 30 also converts the latched data RG, BR, or GB into positive/negative analog gamma compensating voltages in accordance with the polarity control signal POL, and thus generates positive/negative analog data voltages. The data voltages, which are generated from the data driving circuit 30, are supplied to the data lines D1 to Dm through m output channels, respectively. The data voltages, which are output through m output channels, have a polarity pattern exhibiting a horizontal 2-dot inversion, in which the polarities of the data voltages are inverted at intervals of two adjacent output channels, except for the data voltage corresponding to the first output channel ("+−−++−− . . . " or "−++−−++ . . . ").

For a "4i+1"th frame, the data driving circuit 30 inverts the data voltages, which have the horizontal 2-dot inversion polarity pattern, at intervals of one horizontal period (two horizontal lines) in accordance with the first polarity control signal POLa, and supplies the resultant data voltages to the data lines D1 to Dm. For a "4i+2"th frame, the data driving circuit 30 supplies the data voltages, which have the horizontal 2-dot inversion polarity pattern, to the data lines D1 to Dm, without a vertical inversion of the data voltages, in accordance with the second polarity control signal POLb. For a "4i+3"th frame, the data driving circuit 30 supplies data voltages having a polarity pattern inverted from that of the "4i+1"th frame to the data lines D1 to Dm in accordance with the third polarity control signal POLc. For a "4i+4"th frame, the data driving circuit 30 supplies data voltages having a polarity pattern inverted from that of the "4i+2"th frame to the data lines D1 to Dm in accordance with the fourth polarity control signal POLd.

Thus, in accordance with the polarity pattern of the data voltages supplied from the data driving circuit 30 to the data lines D1 to Dm based on the polarity control signal POL, the LCD panel 10 includes first liquid crystal cell groups having a polarity pattern inverted from that of the just-previous frame period, and second liquid crystal cell groups having the same polarity pattern as that of the just-previous frame period. The first and second liquid crystal groups are alternately arranged in a vertical direction at intervals of two horizontal lines. Also, the positions of the first and second liquid crystal groups are reversed at intervals of one frame period. As a result, the data driving frequency of the first liquid crystal cell groups is faster than that of the second liquid crystal cell groups by a factor of two.

The gate driving circuit 40 includes a plurality of gate drive integrated circuits each including a shift register and a level shifter for converting an output signal of the shift register into a signal having a swing width suitable for the driving of the TFTs 12 of the associated liquid crystal cells P. The gate driving circuit 40 sequentially supplies a scan pulse to the gate lines G1 to Gn, in response to the gate control signals GCS. The gate driving circuit 40 may further include an output buffer coupled between each level shifter and an associated one of the gate lines G1 to Gn. The gate driving circuit 40 may be formed on one substrate simultaneously or concurrently with the formation of the TFTs 12 of the LCD panel 10.

The LCD device according to the illustrated embodiment of the present invention further includes a system 50 for supplying the digital video data RGB and the timing signals Vsync, Hsync, DE, and CLK to the timing controller 20.

The system 50 includes a broadcast signal receiver, an external appliance interface circuit, a graphic processing circuit, and a line memory 52. The system 50 extracts video data from a broadcast signal received by the broadcast signal receiver or an image source input from an external appliance through the external appliance interface circuit, converts the extracted video data into digital video data, and supplies the digital video data to the timing controller 20. An interlaced broadcast signal, which is received by the system 50, is stored in the line memory 52. The video data of the interlaced broadcast signal exists only on odd lines in odd frame periods, and exists only on even lines in even frame periods. Accordingly, when the system 50 receives an interlaced broadcast signal, it generates even line data for odd frame periods and odd line data for even frame periods, using a mean value of effective data stored in the line memory 52 or alternatively using a black data value. The system 50 supplies the timing signals Vsync, Hsync, DE, and CLK to the timing controller 20, together with the digital video data.

The system 50 also supplies electric power to the timing controller 20, the data driving circuit 30, the gate driving circuit 40, a DC-DC converter functioning to generate a drive voltage for the LCD display panel 10, and other circuits, for example, an inverter for turning on a light source included in a backlight unit.

FIGS. 7A to 7D are views showing the polarity patterns of data voltages supplied to the LCD panel for different frames in an LCD device driving method according to a first embodiment of the present invention, respectively.

The LCD device driving method according to the first embodiment of the present invention has an LCD panel including first liquid crystal cell groups to which data voltages having polarities inverted from those of a just-previous frame period are supplied, and second liquid crystal cell groups to which data voltages having the same polarities as those of the just-previous frame period are supplied. Further, the first and second liquid crystal cell groups are alternately arranged in a vertical direction at intervals of two horizontal lines, and are reversed in position at intervals of one frame period.

Figure 7A:
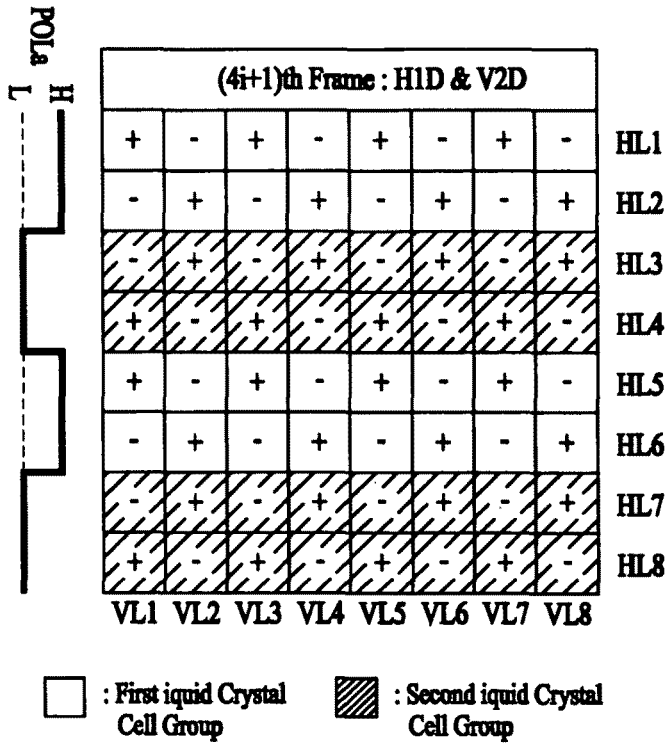
FIGS. 7A to 7D are views showing the polarity patterns of data voltages supplied to the LCD panel for different frames in the LCD device driving method according to the first embodiment of the present invention, respectively.

In detail, for a "4i+1"th frame period, as shown in FIG. 7A, the first liquid crystal cell groups include the liquid crystal cells arranged on the "4i+1"th and "4i+2"th horizontal lines HL1, HL2, HL5, and HL6. For the "4i+1"th frame period, the second liquid crystal cell groups, each of which is arranged between adjacent ones of the first liquid crystal cell groups, include the liquid crystal cells arranged on the "4i+3"th and "4i+4"th horizontal lines HL3, HL4, HL7, and HL8. The polarities of the data voltages charged in the liquid crystal cells of the first and second liquid crystal cell groups are inverted at intervals of two dots (or two liquid crystal cells) in a vertical direction, following a first dot (or a first liquid crystal cell), and are inverted at intervals of one dot (or one liquid crystal cell) in a horizontal direction. For these inversion operations, for the "4i+1"th frame period, the data driving circuit inverts the data voltages, which have a horizontal 2-dot inversion polarity pattern, at intervals of one horizontal period (two horizontal lines), in accordance with the first polarity control signal POLa, and supplies the resultant data voltages to the data lines, respectively. As a result, the liquid crystal cells arranged on one of the horizontal lines coupled in common to each odd gate line and arranged adjacent to each other in a vertical direction, namely, the liquid crystal cells arranged on the "4i+1"th horizontal line HL1 or HL5 of each first liquid crystal cell group, have the polarities of the data voltages supplied from the odd data lines (+−+−+−+−). On the other hand, the liquid crystal cells arranged on the other horizontal line, namely, the liquid crystal cells arranged on the "4i+2"th horizontal line HL2 or HL6 of each first liquid crystal cell group, have the polarities of the data voltages supplied from the even data lines (−+−+−+−+). The liquid crystal cells arranged on one of the horizontal lines coupled in common to each even gate line and arranged adjacent to each other in a vertical direction, namely, the liquid crystal cells arranged on the "4i+3"th horizontal line HL3 or HL7 of each second liquid crystal cell group, have the polarities of the data voltages supplied from the odd data lines (−+−+−++). On the other hand, the liquid crystal cells arranged on the other horizontal line, namely, the liquid crystal cells arranged on the "4i+4"th horizontal line HL4 or HL8 of each second liquid crystal cell group, have the polarities of the data voltages supplied from the even data lines (+−+−+−+−). Thus, for the "4i+1"th frame period, the first and second liquid crystal cell groups are driven in accordance with a horizontal 1-dot inversion (H1D) and vertical 2-dot inversion (V2D) scheme.

Figure 7B:
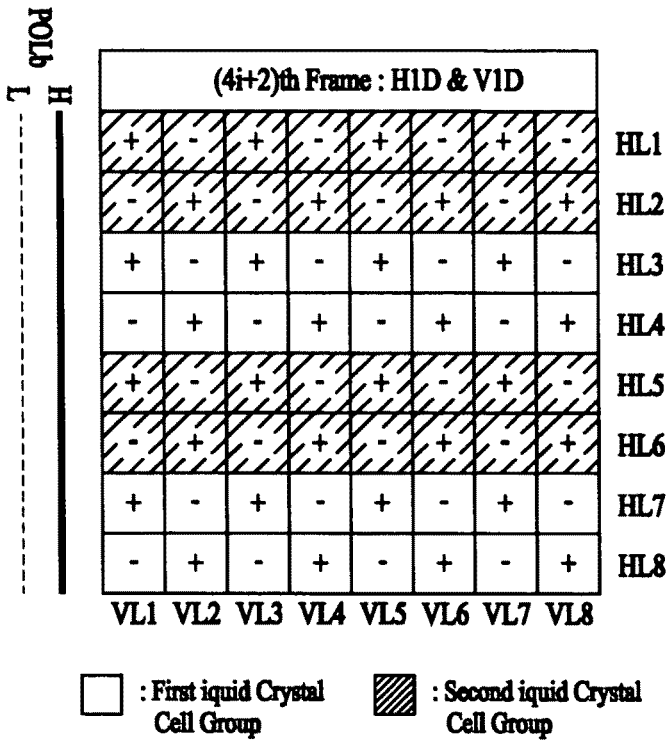

For a "4i+2"th frame period, as shown in FIG. 7B, the second liquid crystal cell groups include the liquid crystal cells arranged on the "4i+1"th and "4i+2"th horizontal lines HL1, HL2, HL5, and HL6. For the "4i+2"th frame period, the first liquid crystal cell groups, each of which is arranged between adjacent ones of the second liquid crystal cell groups, include the liquid crystal cells arranged on the "4i+3"th and "4i+4"th horizontal lines HL3, HL4, HL7, and HL8. The polarities of the data voltages charged in the liquid crystal cells of the first and second liquid crystal cell groups are inverted at intervals of one dot in vertical and horizontal directions. For these inversion operations, for the "4i+2"th frame period, the data driving circuit supplies the data voltages, which have a horizontal 2-dot inversion polarity pattern, to the data lines, respectively, without inverting the data voltages in a vertical direction, in accordance with the second polarity control signal POLb. As a result, the liquid crystal cells arranged on one of the horizontal lines coupled in common to each odd gate line and arranged adjacent to each other in a vertical direction, namely, the liquid crystal cells arranged on the "4i+1"th horizontal line HL1 or HL5 of each second liquid crystal cell group, have the polarities of the data voltages supplied from the odd data lines (+−+−+−+−). On the other hand, the liquid crystal cells arranged on the other horizontal line, namely, the liquid crystal cells arranged on the "4i+2"th horizontal line HL2 or HL6 of each second liquid crystal cell group, have the polarities of the data voltages supplied from the even data lines (−+−+−+−+). The liquid crystal cells arranged on one of the horizontal lines coupled in common to each even gate line and arranged adjacent to each other in a vertical direction, namely, the liquid crystal cells arranged on the "4i+3"th horizontal line HL3 or HL7 of each first liquid crystal cell group, have the polarities of the data voltages supplied from the odd data lines (+−+−+−+−). On the other hand, the liquid crystal cells arranged on the other horizontal line, namely, the liquid crystal cells arranged on the "4i+4"th horizontal line HL4 or HL8 of each first liquid crystal cell group, have the polarities of the data voltages supplied from the even data lines (−+−+−+−+). Thus, for the "4i+2"th frame period, the first and second liquid crystal cell groups are driven in accordance with a horizontal 1-dot inversion (H1D) and vertical 1-dot inversion (V1D) scheme.

Figure 7C:
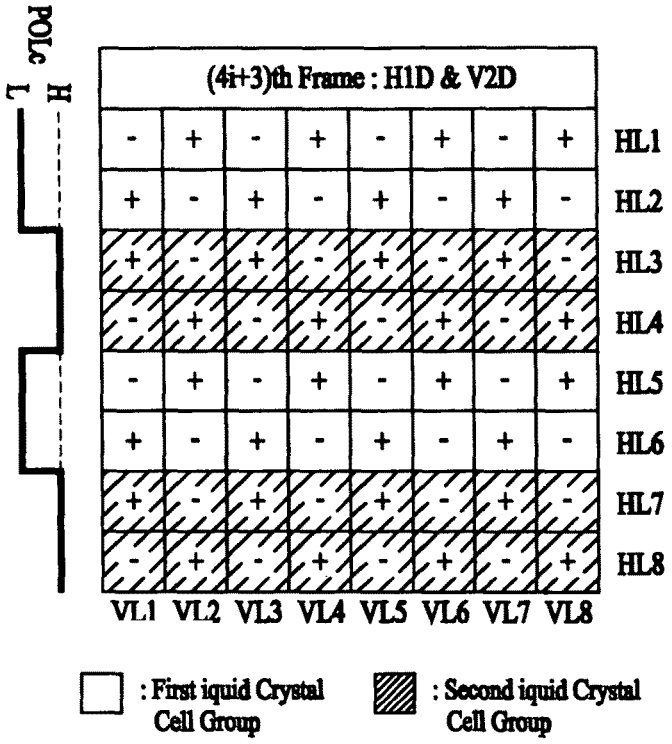

The polarity pattern of the data voltages supplied in a "4i+3"th frame period is opposite to that of the "4i+1"th frame period, as shown in FIG. 7C. For the "4i+3"th frame period, the first liquid crystal cell groups include the liquid crystal cells arranged on the "4i+1"th and "4i+2"th horizontal lines HL1, HL2, HL5, and HL6. For the "4i+3"th frame period, the second liquid crystal cell groups, each of which is arranged between adjacent ones of the first liquid crystal cell groups, include the liquid crystal cells arranged on the "4i+3"th and "4i+4"th horizontal lines HL3, HL4, HL7, and HL8. The polarities of the data voltages charged in the liquid crystal cells of the first and second liquid crystal cell groups are inverted at intervals of two dots in a vertical direction, following a first dot, and are inverted at intervals of one dot in a horizontal direction. For these inversion operations, for the "4i+3"th frame period, the data driving circuit inverts the data voltages, which have a horizontal 2-dot inversion polarity pattern, at intervals of one horizontal period (two horizontal lines), in accordance with the third polarity control signal POLc, and supplies the resultant data voltages to the data lines, respectively. As a result, the liquid crystal cells arranged on one of the horizontal lines coupled in common to each odd gate line and arranged adjacent to each other in a vertical direction, namely, the liquid crystal cells arranged on the "4i+1"th horizontal line HL1 or HL5 of each first liquid crystal cell group, have the polarities of the data voltages supplied from the odd data lines (−+−+−+−+). On the other hand, the liquid crystal cells arranged on the other horizontal line, namely, the liquid crystal cells arranged on the "4i+2"th horizontal line HL2 or HL6 of each first liquid crystal cell group, have the polarities of the data voltages supplied from the even data lines (+−+−+−+−). The liquid crystal cells arranged on one of the horizontal lines coupled in common to each even gate line and arranged adjacent to each other in a vertical direction, namely, the liquid crystal cells arranged on the "4i+3"th horizontal line HL3 or HL7 of each second liquid crystal cell group, have the polarities of the data voltages supplied from the odd data lines (+−+−+−+−). On the other hand, the liquid crystal cells arranged on the other horizontal line, namely, the liquid crystal cells arranged on the "4i+4"th horizontal line HL4 or HL8 of each second liquid crystal cell group, have the polarities of the data voltages supplied from the even data lines (−+−+−+−+). Thus, for the "4i+3"th frame period, the first and second liquid crystal cell groups are driven in accordance with a horizontal 1-dot inversion (H1D) and vertical 2-dot inversion (V2D) scheme. Also, for the "4i+3"th frame period, the first liquid crystal cell groups are changed to the second liquid crystal cell groups, and the second liquid crystal cell groups are changed to the first liquid crystal cell groups, to reverse the positions of the first and second liquid crystal cell groups to each other such that the polarity pattern in the "4i+3"th frame period is identical to that in the "4i+1"th frame period.

Figure 7D:
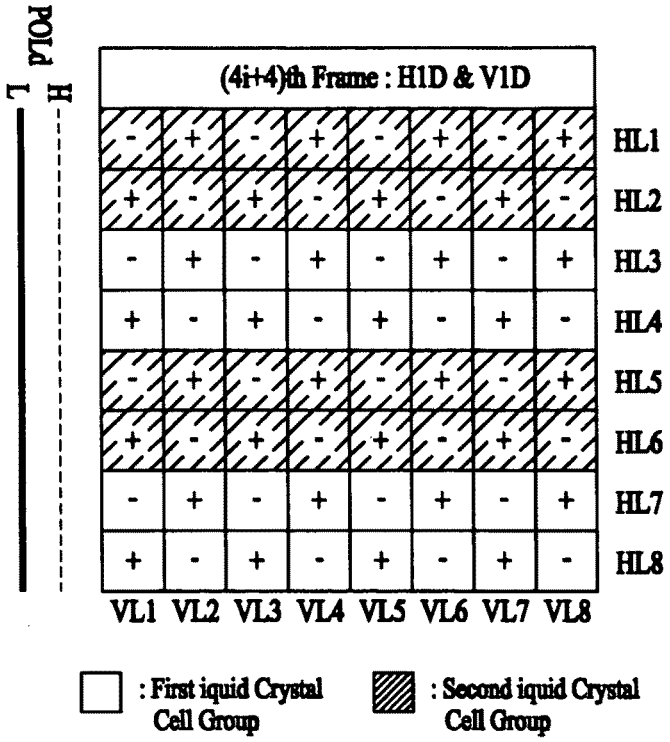

The polarity pattern of the data voltages supplied in a "4i+4"th frame period is opposite to that of the "4i+2"th frame period, as shown in FIG. 7D. For a "4i+4"th frame period, the second liquid crystal cell groups include the liquid crystal cells arranged on the "4i+1"th and "4i+2"th horizontal lines HL1, HL2, HL5, and HL6. For the "4i+4"th frame period, the first liquid crystal cell groups, each of which is arranged between adjacent ones of the second liquid crystal cell groups, include the liquid crystal cells arranged on the "4i+3"th and "4i+4"th horizontal lines HL3, HL4, HL7, and HL8. The polarities of the data voltages charged in the liquid crystal cells of the first and second liquid crystal cell groups are inverted at intervals of one dot in vertical and horizontal directions. For these inversion operations, for the "4i+4"th frame period, the data driving circuit supplies the data voltages, which have a horizontal 2-dot inversion polarity pattern, to the data lines, respectively, without inverting the data voltages in a vertical direction, in accordance with the fourth polarity control signal POLd. As a result, the liquid crystal cells arranged on one of the horizontal lines coupled in common to each odd gate line and arranged adjacent to each other in a vertical direction, namely, the liquid crystal cells arranged on the "4i+1"th horizontal line HL1 or HL5 of each second liquid crystal cell group, have the polarities of the data voltages supplied from the odd data lines (−+−+−+−+). On the other hand, the liquid crystal cells arranged on the other horizontal line, namely, the liquid crystal cells arranged on the "4i+2"th horizontal line HL2 or HL6 of each second liquid crystal cell group, have the polarities of the data voltages supplied from the even data lines (+−+−+−+−). The liquid crystal cells arranged on one of the horizontal lines coupled in common to each even gate line and arranged adjacent to each other in a vertical direction, namely, the liquid crystal cells arranged on the "4i+3"th horizontal line HL3 or HL7 of each first liquid crystal cell group, have the polarities of the data voltages supplied from the odd data lines (−+−+−+−+). On the other hand, the liquid crystal cells arranged on the other horizontal line, namely, the liquid crystal cells arranged on the "4i+4"th horizontal line HL4 or HL8 of each first liquid crystal cell group, have the polarities of the data voltages supplied from the even data lines (+−+−+−+−). Thus, for the "4i+4"th frame period, the first and second liquid crystal cell groups are driven in accordance with a horizontal 1-dot inversion (H1D) and vertical 1-dot inversion (V1D) scheme. Also, for the "4i+4"th frame period, the first liquid crystal cell groups are changed to the second liquid crystal cell groups, and the second liquid crystal cell groups are changed to the first liquid crystal cell groups, to reverse the positions of the first and second liquid crystal cell groups to each other such that the polarity pattern in the "4i+4"th frame period is identical to that in the "4i+2"th frame period.

Thus, the LCD device and control method thereof according to the first embodiment of the present invention change the first liquid crystal cell groups to the second liquid crystal cell groups while changing the second liquid crystal cell groups to the first liquid crystal cell groups, at intervals of one frame, as shown in FIGS. 7A to 7D, such that the driving frequency of the data voltages supplied to the second liquid crystal cell group is controlled to be low, in order to prevent DC image sticking, and the driving frequency of the data voltage supplied to the first liquid crystal cell group is controlled to be high, in order to prevent flicker. Thus, it is possible to achieve an enhancement in display quality.

In detail, line-shaped flicker may be generated in every frame because the liquid crystal cells of each first liquid crystal cell have a polarity inversion interval longer than that of each second liquid crystal cell. Also, wave noise may be generated due to a brightness difference among different horizontal lines when flicker is generated at the same position for 3 or more successive frame periods. In accordance with the illustrated embodiment of the present invention, however, the positions of line-shaped flicker alternate at intervals of two frame periods, so that flicker offset is achieved. Accordingly, it is possible to prevent the generation of flicker and wave noise.

Figure 8:
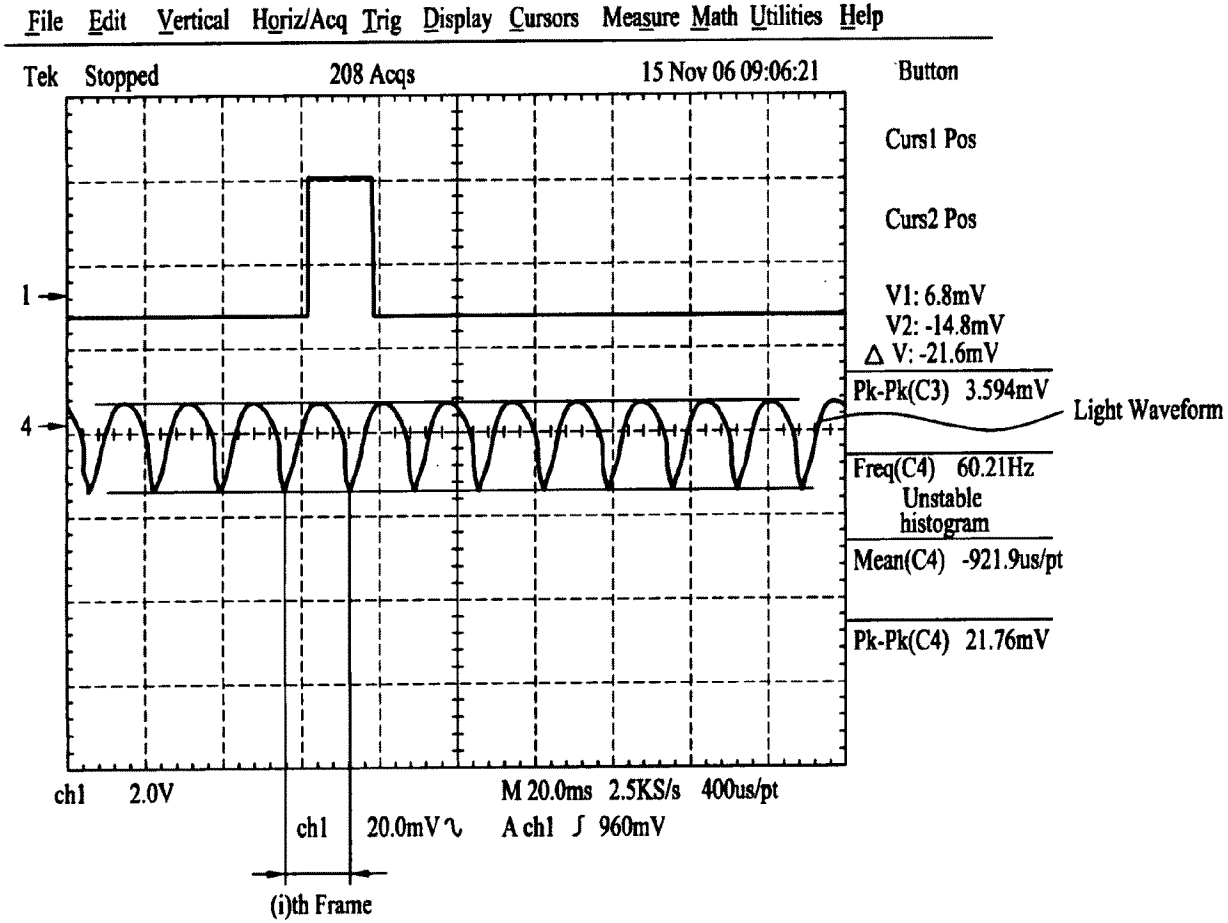
FIG. 8 is a waveform diagram depicting the waveform of light measured in the LCD panel when data voltages as shown in FIGS. 7A to 7D are supplied.

FIG. 8 depicts the results of an experiment in which 127-grayscale data voltages having polarity patterns of FIGS. 7A to 7D are supplied to the LCD panel, to measure the voltage waveform of the LCD panel. In this experiment, the LCD panel is driven at a frequency of 60 Hz due to the second liquid crystal cell groups. If all liquid crystal cells of the LCD panel are driven as those of the first liquid crystal cell groups, the driving frequency thereof is lowered to 30 Hz. In this case, 30 Hz-flicker is generated. In this experiment, however, the light waveform of the LCD panel sample measured by an optical sensor installed on the LCD display panel sample was 60 Hz due to the second liquid crystal cell groups. This is because the light waveform measured in the LCD panel is not determined by the light conversion cycle of the first liquid crystal cell groups having a low driving frequency, but is determined by the light conversion cycle of the second liquid crystal cell groups having a high driving frequency, within two frame periods.

Figure 9:
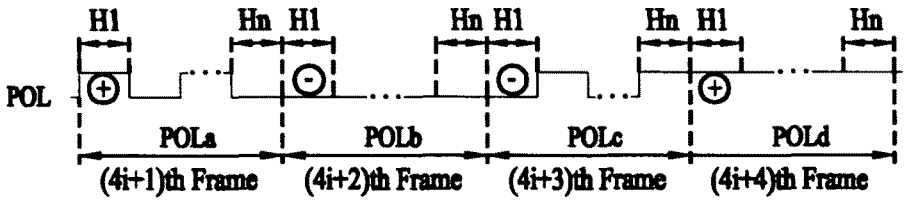
FIG. 9 is a waveform diagram depicting a polarity control signal according to a second embodiment of the present invention.

FIG. 9 is a waveform diagram depicting a polarity control signal in an LCD device according to a second embodiment of the present invention.

When comparing FIG. 9 with FIG. 5, it can be seen that the LCD device according to the second embodiment of the present invention has the same configuration as the first embodiment of the present invention, except for the polarity control signal POL generated from the timing controller 20. Accordingly, a detailed description of those elements having the same configuration as the LCD device according to the first embodiment will be omitted.

In accordance with the second embodiment of the present invention, the timing controller 20 generates polarity control signals POL having a different sequence of logic levels at intervals of 4 frames, and supplies the generated polarity control signals POL to the data driving circuit 30. That is, as shown in FIG. 9, the timing controller 20 supplies a first polarity control signal POLa to the data driving circuit 30, for a "4i+1"th frame. The first polarity control signal POLa has a level that inverts between a high level H and a low level L or between a low level L and a high level H at intervals of one horizontal period (two horizontal lines). For a "4i+2"th frame, the timing controller 20 supplies a second polarity control signal POLb to the data driving circuit 30. The second polarity control signal POLb has a level maintained at the low level L. For a "4i+3"th frame, the timing controller 20 supplies a third polarity control signal POLc to the data driving circuit 30. The third polarity control signal POLc has a waveform inverted from that of the first polarity control signal POLa. For a "4i+4"th frame, the timing controller 20 supplies a fourth polarity control signal POLd to the data driving circuit 30. The fourth polarity control signal POLd has a waveform inverted from that of the second polarity control signal POLb.

FIGS. 10A to 10D are views showing the polarity patterns of data voltages supplied to the LCD panel for different frames in an LCD device driving method according to a second embodiment of the present invention, respectively.

As in the first embodiment of the present invention, the LCD device driving method according to the second embodiment of the present invention the LCD panel includes first liquid crystal cell groups to which data voltages having polarities inverted from those of a just-previous frame period are supplied and second liquid crystal cell groups to which data voltages having the same polarities as those of the just-previous frame period are supplied. Further, the first and second liquid crystal cell groups are alternately arranged in a vertical direction at intervals of two horizontal lines, and are reversed in position at intervals of one frame period.

Figure 10A:
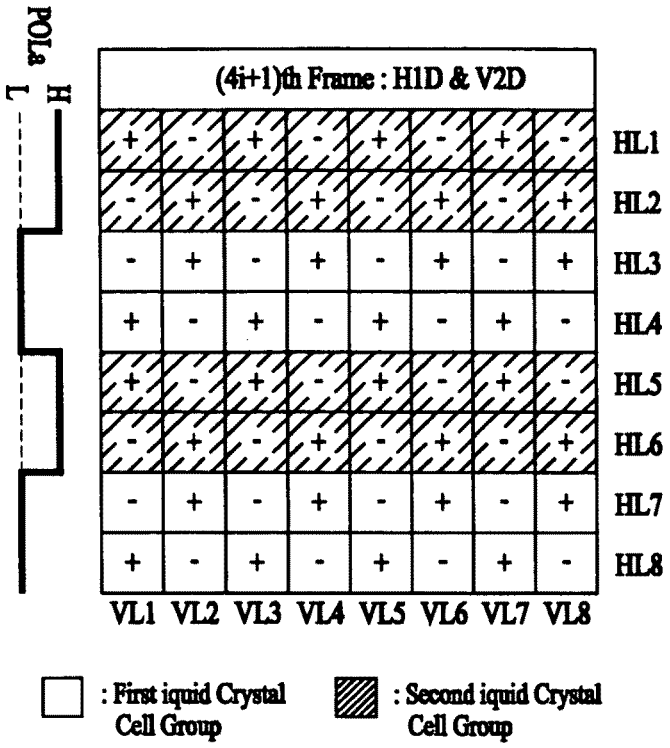
FIGS. 10A to 10D are views showing the polarity patterns of data voltages supplied to an LCD panel for different frames in accordance with the second embodiment of the present invention, respectively.

In detail, in a "4i+1"th frame period, as shown in FIG. 10A, the liquid crystal cells are driven in the same manner as that of the first embodiment shown in FIG. 7A. Accordingly, no further description will be given. Thus, for the "4i+1"th frame period, the first and second liquid crystal cell groups are driven in accordance with a horizontal 1-dot inversion (H1D) and vertical 2-dot inversion (V2D) scheme.

Figure 10B:
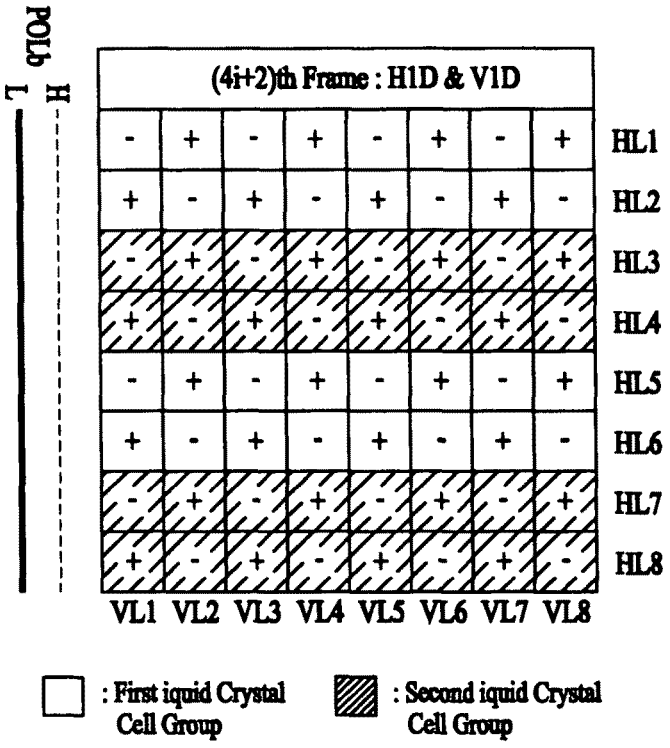

In a "4i+2"th frame period, as shown in FIG. 10B, the liquid crystal cells are driven in the same manner as that of the first embodiment shown in FIG. 7C. Accordingly, no further description will be given. Thus, for the "4i+2"th frame period, the first and second liquid crystal cell groups are driven in accordance with a horizontal 1-dot inversion (H1D) and vertical 1-dot inversion (V1D) scheme. Also, for the "4i+2"th frame period, the first liquid crystal cell groups are changed to the second liquid crystal cell groups, and the second liquid crystal cell groups are changed to the first liquid crystal cell groups, to reverse the positions of the first and second liquid crystal cell groups to each other.

Figure 10C:
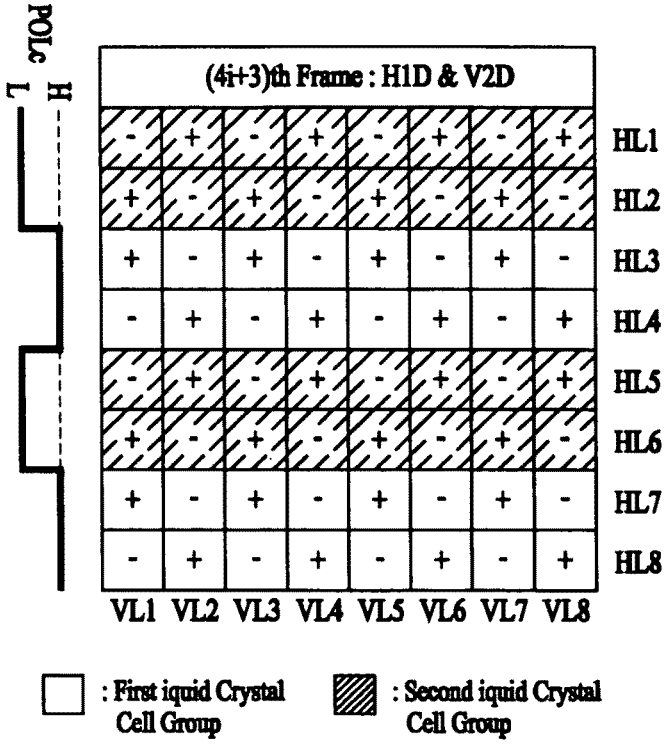

The polarity pattern of the data voltages supplied in a "4i+3"th frame period is opposite to that of the "4i+1"th frame period, as shown in FIG. 10C. Thus, for the "4i+3"th frame period, the first and second liquid crystal cell groups are driven in accordance with a horizontal 1-dot inversion (H1D) and vertical 2-dot inversion (V2D) scheme. Also, for the "4i+3"th frame period, the first liquid crystal cell groups are changed to the second liquid crystal cell groups, and the second liquid crystal cell groups are changed to the first liquid crystal cell groups, to reverse the positions of the first and second liquid crystal cell groups to each other such that the polarity pattern in the "4i+3"th frame period is identical to that in the "4i+1"th frame period.

Figure 10D:
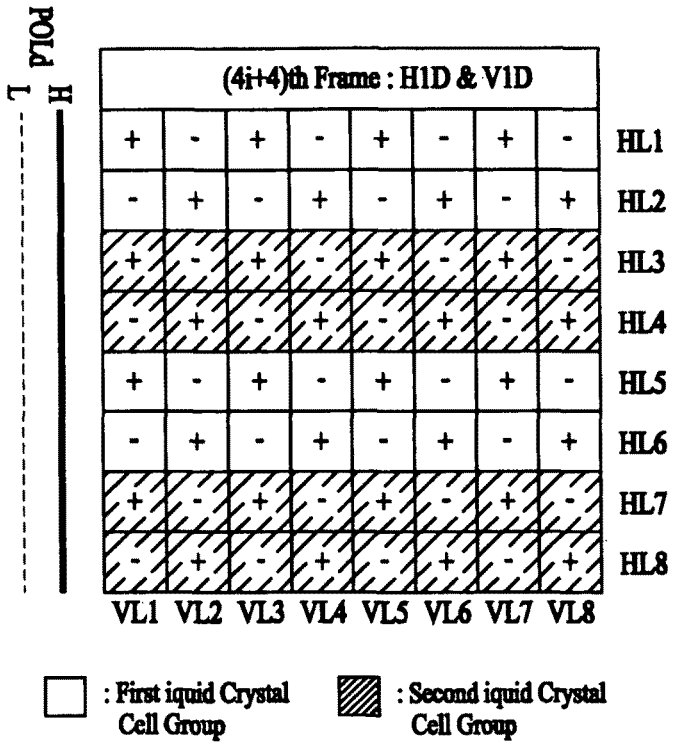

The polarity pattern of the data voltages supplied in a "4i+4"th frame period is opposite to that of the "4i+2"th frame period, as shown in FIG. 10D. Thus, for the "4i+4"th frame period, the first and second liquid crystal cell groups are driven in accordance with a horizontal 1-dot inversion (H1D) and vertical 1-dot inversion (V1D) scheme. Also, for the "4i+4"th frame period, the first liquid crystal cell groups are changed to the second liquid crystal cell groups, and the second liquid crystal cell groups are changed to the first liquid crystal cell groups, to reverse the positions of the first and second liquid crystal cell groups to each other such that the polarity pattern in the "4i+4"th frame period is identical to that in the "4i+2"th frame period.

Thus, as shown in FIGS. 10A to 10D, the LCD device and control method thereof according to the second embodiment of the present invention change the first liquid crystal cell groups to the second liquid crystal cell groups while changing the second liquid crystal cell groups to the first liquid crystal cell groups, at intervals of one frame, such that the driving frequency of the data voltages supplied to the second liquid crystal cell group is controlled to be low, in order to prevent DC image sticking, and the driving frequency of the data voltage supplied to the first liquid crystal cell group is controlled to be high, in order to prevent flicker. Thus, it is possible to achieve an enhancement in display quality.

Figure 11:
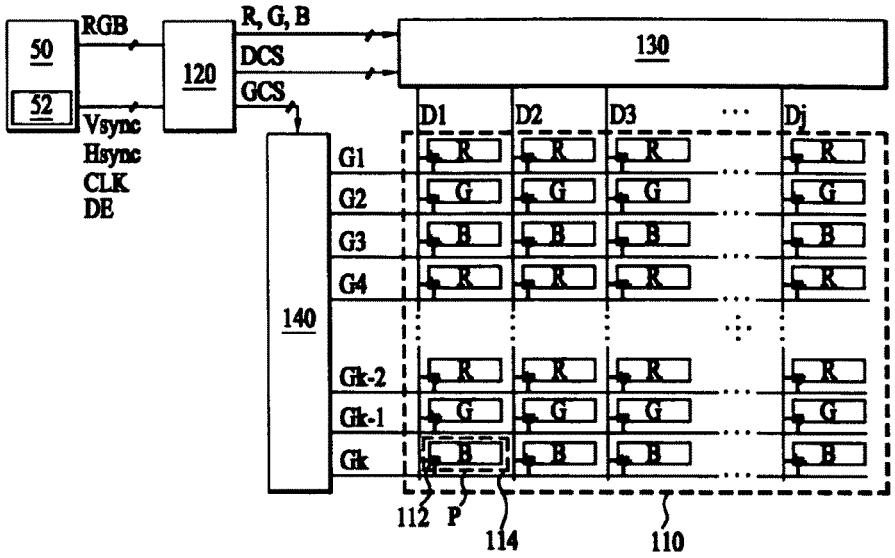
FIG. 11 is a block diagram illustrating an LCD device according to a second embodiment of the present invention.

FIG. 11 is a block diagram schematically illustrating an LCD device according to a second embodiment of the present invention.

Referring to FIG. 11, the LCD device according to the second embodiment of the present invention includes an LCD panel 110, a timing controller 120, a data driving circuit 130, and a gate driving circuit 140.

The LCD panel 110 includes two glass substrates, between which a liquid crystal layer is formed. The LCD panel 110 also includes liquid crystal cells P formed in regions defined by crossings of a plurality of data lines D1 to Dj with a plurality of gate lines G1 to Gk.

Each liquid crystal cell P includes a thin film transistor (TFT) 112 coupled to one of the gate lines G1 to Gk and to one of the data lines D1 to Dj, and a pixel electrode 114 coupled to the TFT 112. Each liquid crystal cell P further includes a liquid crystal capacitor (not shown) and a storage capacitor (not shown), as in the first embodiment of the present invention.

The pixel electrode 114 of each liquid crystal cell P has a horizontal structure having longer sides extending in parallel to the gate lines G and shorter sides extending in parallel to the data lines D. The pixel electrode 114 may be formed to have a structure including no extension portion, a parallel structure including one or more uniformly-spaced bent or curved extension portions, or a parallel structure having one or more uniformly-spaced straight extension portions.

Each liquid crystal capacitor generates an electric field in accordance with a voltage difference between a data voltage supplied to the pixel electrode 114 and a common voltage supplied to the common electrode, to drive liquid crystals. The storage capacitor stores the voltage difference between the data voltage and the common voltage, to enable the voltage stored in the liquid crystal capacitor to be maintained even after the TFT 112 is turned off.

Three liquid crystal cells P arranged adjacent to one another in a vertical direction constitute one unit pixel. The liquid crystal cells P arranged adjacent to one another in a vertical direction constitute one unit pixel. The liquid crystal cells P in a horizontal line have the same color, while the liquid crystal cells in a common vertical line vary in color as in the first embodiment of the present invention.

The timing controller 120 generates timing control signals to control the operation timings of the data driving circuit 130 and gate driving circuit 140, as in the first embodiment of the present invention.

Figure 12:
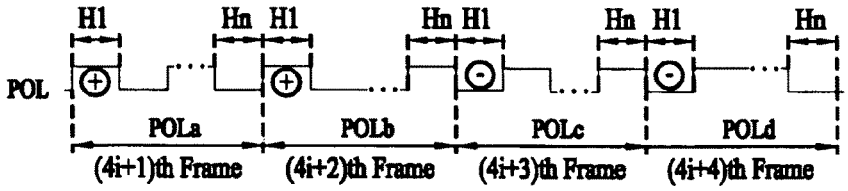
FIG. 12 is a waveform diagram depicting a polarity control signal according to a third embodiment of the present invention.

The timing controller 120 generates polarity control signals POL having a different sequence of logic levels at intervals of 4 frames, and supplies the generated polarity control signals POL to the data driving circuit 130. That is, as shown in FIG. 12, the timing controller 120 supplies a first polarity control signal POLa to the data driving circuit 130, for a "4i+1"th frame. The first polarity control signal POLa has a level that inverts between a high level H and a low level L or between a low level L and a high level H at intervals of one horizontal period (one horizontal line). For a "4i+2"th frame, the timing controller 120 supplies a second polarity control signal POLb to the data driving circuit 130. The second polarity control signal POLb has a level inverted between a high level H and a low level L at intervals of two horizontal periods (two horizontal lines). For a "4i+3"th frame, the timing controller 120 supplies a third polarity control signal POLc to the data driving circuit 130. The third polarity control signal POLc has a waveform inverted from that of the first polarity control signal POLa. For a "4i+4"th frame, the timing controller 120 supplies a fourth polarity control signal POLd to the data driving circuit 130. The fourth polarity control signal POLd has a waveform inverted from that of the second polarity control signal POLb.

The timing controller 120 arranges input digital video data RGB such that the input digital video data RGB corresponds to the arrangement structure of the liquid crystal cells P formed on each horizontal line of the LCD panel 110. The timing controller 120 supplies the arranged digital video data RGB to the data driving circuit 130. That is, the timing controller 120, which sequentially receives input digital video data RGB in the unit of one horizontal line, arranges red (R) data, green G) data, and blue (B) data of one-horizontal-line input digital video data RGB as data R for a "3i+1"th horizontal line, data G for a "3i+2"th horizontal line, and data B for a "3i+3"th horizontal line, respectively, and supplies the arranged data to the data driving circuit 130.

The data driving circuit 130 latches the data R, G, or B for each one horizontal line input from the timing controller 120, under the control of the timing controller 120. The data driving circuit 130 also converts the latched data R, G, or B into positive/negative analog gamma compensating voltages in accordance with the polarity control signal POL, and thus generates positive/negative analog data voltages. The data voltages, which are generated from the data driving circuit 130, are supplied to the data lines D1 to Dj through j output channels, respectively. The data voltages, which are output through j output channels, have a polarity pattern exhibiting a horizontal 1-dot inversion, in which the polarities of the data voltages are inverted at intervals of one output channel ("+−+− . . . ", or "−+−+ . . . ").

For a "4i+1"th frame, the data driving circuit 130 inverts the data voltages, which have the horizontal 1-dot inversion polarity pattern, at intervals of one horizontal period (one horizontal line) in accordance with the first polarity control signal POLa, and supplies the resultant data voltages to the data lines D1 to Dj. For a "4i+2"th frame, the data driving circuit 130 inverts the data voltage corresponding to a first dot in a vertical direction, from among the data voltages, which have the horizontal 1-dot inversion polarity pattern, while inverting the remaining data voltages in accordance with a vertical 2-dot inversion scheme, in accordance with the second polarity control signal POLb, and supplies the resultant data voltages to the data lines D1 to Dj. For a "4i+3"th frame, the data driving circuit 130 supplies data voltages having a polarity pattern inverted from that of the "4i+1"th frame to the data lines D1 to Dj in accordance with the third polarity control signal POLc. For a "4i+4"th frame, the data driving circuit 130 supplies data voltages having a polarity pattern inverted from that of the "4i+2"th frame to the data lines D1 to Dj in accordance with the fourth polarity control signal POLd.

The gate driving circuit 140 includes a plurality of gate drive integrated circuits each including a shift register and a level shifter for converting an output signal of the shift register into a signal having a swing width suitable for the driving of the TFTs 112 of the associated liquid crystal cells P. The gate driving circuit 140 sequentially supplies a scan pulse to the gate lines G1 to Gk; in response to the gate control signals GCS. The gate driving circuit 140 may further includes an output buffer coupled between each level shifter and an associated one of the gate lines G1 to Gk. The gate driving circuit 140 may be formed on one substrate, simultaneously with the formation of the TFTs 112 of the LCD panel 110.

The LCD device according to the illustrated embodiment of the present invention further includes a system 50 for supplying the digital video data RGB and the timing signals Vsync, Hsync, DE, and CLK to the timing controller 120. Since the system 50 has the same configuration as that of the first embodiment, no further description thereof will be given.

FIGS. 13A to 13D are views showing the polarity patterns of data voltages supplied to the LCD panel for different frames in an LCD device driving method according to the third embodiment of the present invention, respectively.

In the LCD device driving method according to the third embodiment of the present invention the LCD panel includes first liquid crystal cell groups to which data voltages having polarities inverted from those of a just-previous frame period are supplied, and second liquid crystal cell groups, to which data voltages having the same polarities as those of the just-previous frame period are supplied, and in that the first and second liquid crystal cell groups are alternately arranged in a vertical direction at intervals of two horizontal lines, and are reversed in position at intervals of one frame period.

Figure 13A:
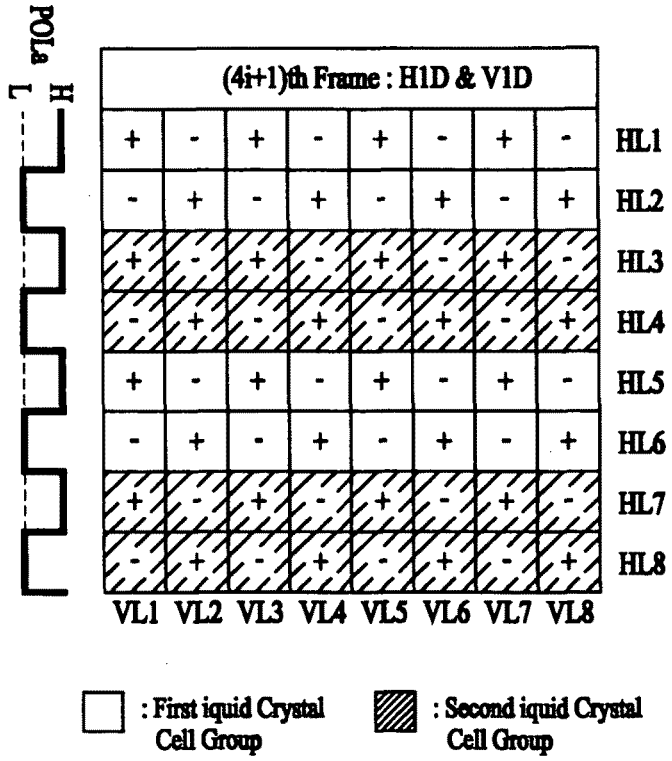
FIGS. 13A to 13D are views showing the polarity patterns of data voltages supplied to an LCD panel for different frames in accordance with the third embodiment of the present invention, respectively.

In detail, for a "4i+1"th frame period, as shown in FIG. 13A, the first liquid crystal cell groups include the liquid crystal cells arranged on the "4i+1"th and "4i+2"th horizontal lines HL1, HL2, HL5, and HL6. For the "4i+1"th frame period, the second liquid crystal cell groups, each of which is arranged between adjacent ones of the first liquid crystal cell groups, include the liquid crystal cells arranged on the "4i+3"th and "4i+4"th horizontal lines HL3, HL4, HL7, and HL8. The polarities of the data voltages charged in the liquid crystal cells of the first and second liquid crystal cell groups are inverted at intervals of one dot in vertical and horizontal directions. For these inversion operations, for the "4i+1"th frame period, the data driving circuit inverts the data voltages, which have a horizontal 1-dot inversion polarity pattern, at intervals of one horizontal line in a vertical direction, in accordance with the first polarity control signal POLa, and supplies the resultant data voltages to the data lines, respectively. Thus, for the "4i+1"th frame period, the first and second liquid crystal cell groups are driven in accordance with a horizontal 1-dot inversion (H1D) and vertical 1-dot inversion (V1D) scheme.

Figure 13B:
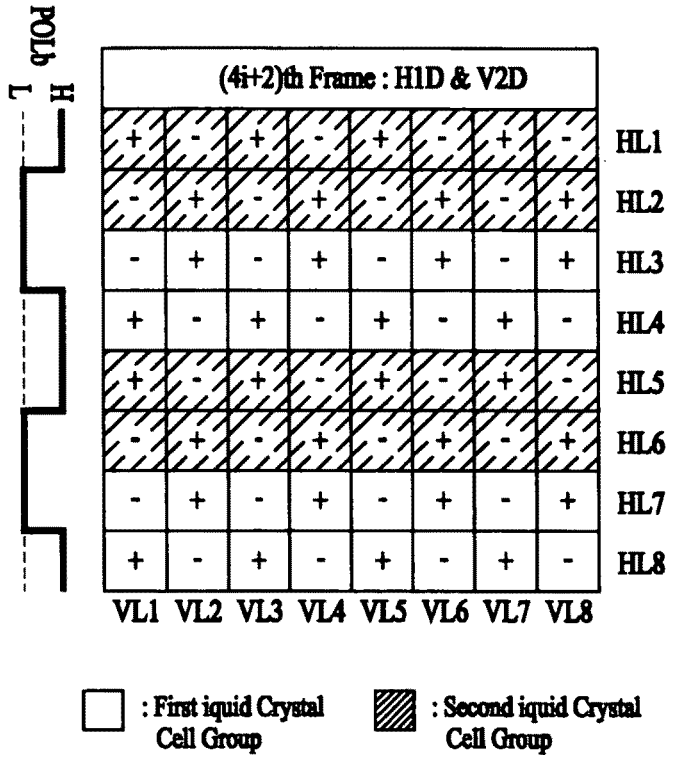

For a "4i+2"th frame period, as shown in FIG. 13B, the second liquid crystal cell groups include the liquid crystal cells arranged on the "4i+1"th and "4i+2"th horizontal lines HL1, HL2, HL5, and HL6. For the "4i+2"th frame period, the first liquid crystal cell groups, each of which is arranged between adjacent ones of the second liquid crystal cell groups, include the liquid crystal cells arranged on the "4i+3"th and "4i+4"th horizontal lines HL3, HL4, HL7, and HL8. The polarities of the data voltages charged in the liquid crystal cells of the first and second liquid crystal cell groups are inverted at intervals of two dots in a vertical direction, following a first dot, and are inverted at intervals of one dot in a horizontal direction. For these inversion operations, for the "4i+2"th frame period, the data driving circuit inverts the data voltages, which have a horizontal 1-dot inversion polarity pattern, at intervals of two horizontal periods (two horizontal lines), in accordance with the second polarity control signal POLb, and supplies the resultant data voltages to the data lines, respectively. Thus, for the "4i+2"th frame period, the first and second liquid crystal cell groups are driven in accordance with a horizontal 1-dot inversion (H1D) and vertical 2-dot inversion (V2D) scheme. Also, for the "4i+2"th frame period, the first liquid crystal cell groups are changed to the second liquid crystal cell groups, and the second liquid crystal cell groups are changed to the first liquid crystal cell groups, to reverse the positions of the first and second liquid crystal cell groups to each other.

Figure 13C:
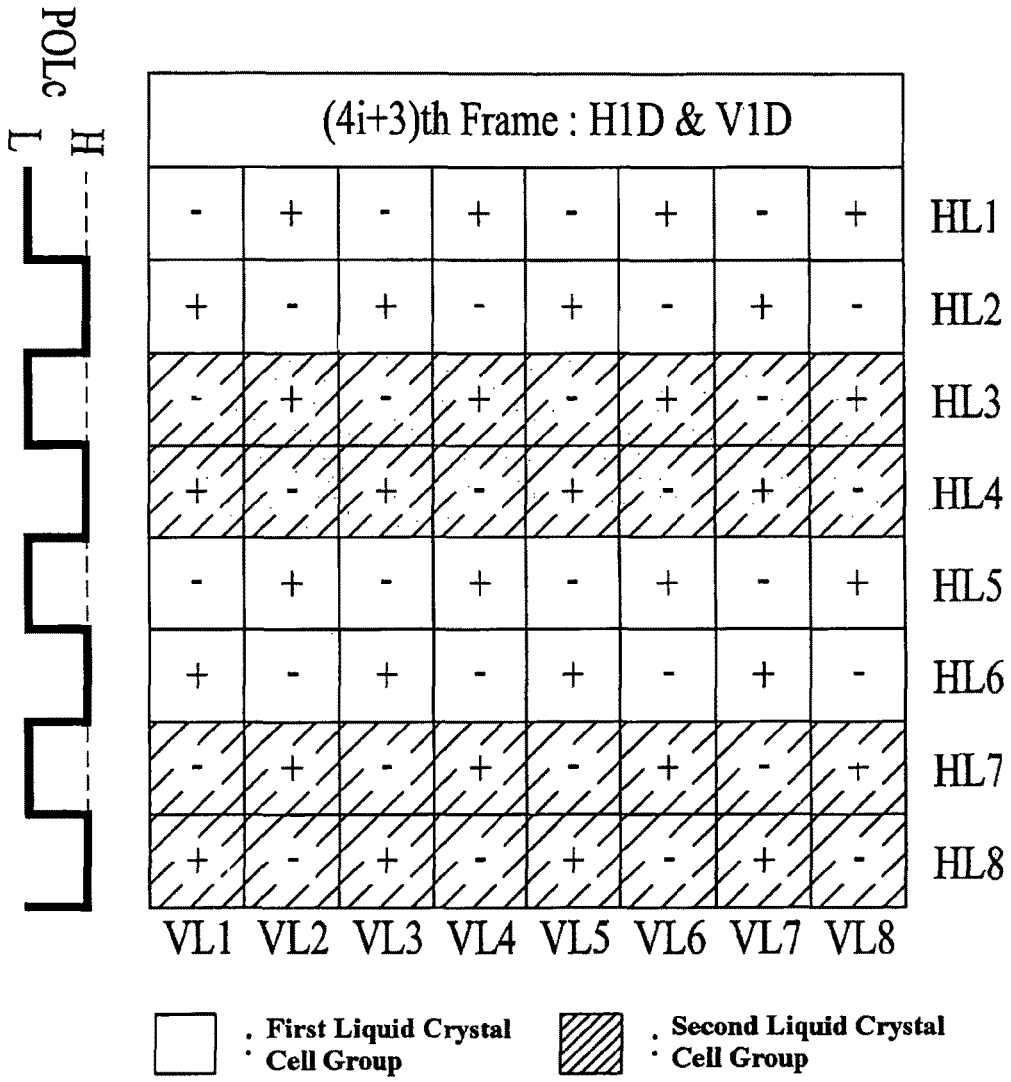

The polarity pattern of the data voltages supplied in a "4i+3"th frame period is opposite to that of the "4i+1"th frame period, as shown in FIG. 13C. For the "4i+3"th frame period, the first liquid crystal cell groups include the liquid crystal cells arranged on the "4i+1"th and "4i+2"th horizontal lines HL1, HL2, HL5, and HL6. For the "4i+3"th frame period, the second liquid crystal cell groups, each of which is arranged between adjacent ones of the first liquid crystal cell groups, include the liquid crystal cells arranged on the "4i+3"th and "4i+4"th horizontal lines HL3, HL4, HL7, and HL8. The polarities of the data voltages charged in the liquid crystal cells of the first and second liquid crystal cell groups are inverted at intervals of one dot in vertical and horizontal directions. For these inversion operations, for the "4i+3"th frame period, the data driving circuit inverts the data voltages, which have a horizontal 1-dot inversion polarity pattern, at intervals of one horizontal period (one horizontal line) in accordance with the third polarity control signal POLc, and supplies the resultant data voltages to the data lines, respectively. Thus, for the "4i+3"th frame period, the first and second liquid crystal cell groups are driven in accordance with a horizontal 1-dot inversion (H1D) and vertical 1-dot inversion (V1D) scheme. Also, for the "4i+3"th frame period, the first liquid crystal cell groups are changed to the second liquid crystal cell groups, and the second liquid crystal cell groups are changed to the first liquid crystal cell groups, to reverse the positions of the first and second liquid crystal cell groups to each other such that the polarity pattern in the "4i+3"th frame period is identical to that in the "4i+1"th frame period.

Figure 13D:
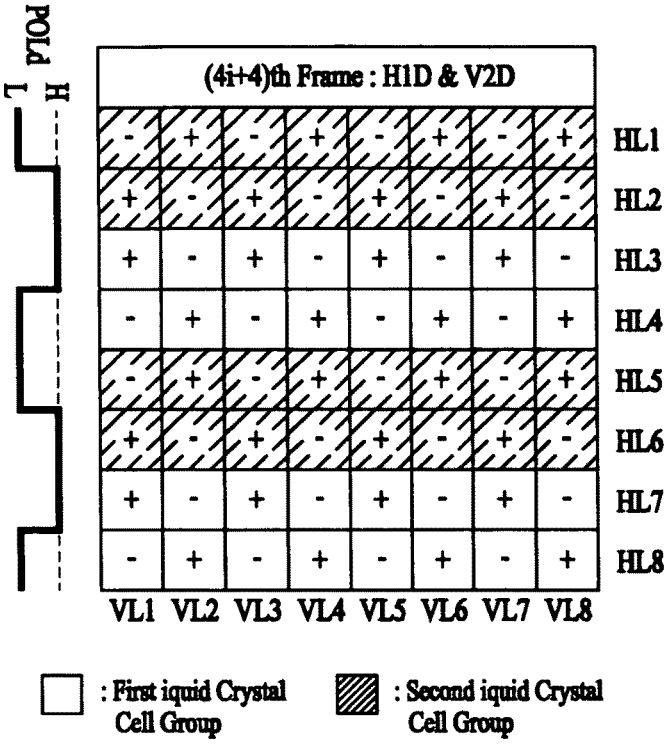

The polarity pattern of the data voltages supplied in a "4i+4"th frame period is opposite to that of the "4i+2"th frame period, as shown in FIG. 13D. For a "4i+4"th frame period, the second liquid crystal cell groups include the liquid crystal cells arranged on the "4i+1"th and "4i+2"th horizontal lines HL1, HL2, HL5, and HL6. For the "4i+4"th frame period, the first liquid crystal cell groups, each of which is arranged between adjacent ones of the second liquid crystal cell groups, include the liquid crystal cells arranged on the "4i+3"th and "4i+4"th horizontal lines HL3, HL4, HL7, and HL8. The polarities of the data voltages charged in the liquid crystal cells of the first and second liquid crystal cell groups are inverted at intervals of two dots in a vertical direction, following a first dot, and are inverted at intervals of one dot in a horizontal direction. For these inversion operations, for the "4i+4"th frame period, the data driving circuit inverts the data voltages, which have a horizontal 1-dot inversion polarity pattern, at intervals of two horizontal periods (two horizontal lines), in accordance with the fourth polarity control signal POLd, and supplies the resultant data voltages to the data lines, respectively. Thus, for the "4i+4"th frame period, the first and second liquid crystal cell groups are driven in accordance with a horizontal 1-dot inversion (H1D) and vertical 2-dot inversion (V2D) scheme. Also, for the "4i+4"th frame period, the first liquid crystal cell groups are changed to the second liquid crystal cell groups, and the second liquid crystal cell groups are changed to the first liquid crystal cell groups, to reverse the positions of the first and second liquid crystal cell groups to each other such that the polarity pattern in the "4i+4"th frame period is identical to that in the "4i+2"th frame period.

Thus, the LCD device and control method thereof according to the third embodiment of the present invention change the first liquid crystal cell groups to the second liquid crystal cell groups while changing the second liquid crystal cell groups to the first liquid crystal cell groups, at intervals of one frame, as shown in FIGS. 13A to 13D such that the driving frequency of the data voltages supplied to the second liquid crystal cell group is controlled to be low, in order to prevent DC image sticking, and the driving frequency of the data voltage supplied to the first liquid crystal cell group is controlled to be high, in order to prevent flicker. Thus, it is possible to achieve an enhancement in display quality.

Also, in the LCD device and control method thereof according to the third embodiment of the present invention, the color arrangement thereof is a horizontal color arrangement, in which the liquid crystal cells on each horizontal line have the same color, so that it is possible to reduce the number of data lines to ⅓ of the number of data lines in a vertical color arrangement, in which the liquid crystal cells on each horizontal line have different colors.

Figure 14:
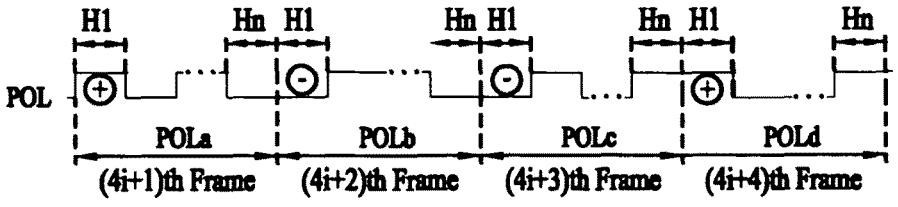
FIG. 14 is a waveform diagram depicting a polarity control signal according to a fourth embodiment of the present invention.

FIG. 14 is a waveform diagram depicting a polarity control signal in an LCD device according to a fourth embodiment of the present invention.

When comparing FIG. 14 with FIG. 11, it can be seen that the LCD device according to the fourth embodiment of the present invention has the same configuration as the third embodiment of the present invention, except for the polarity control signal POL generated from the timing controller 120. Accordingly, a detailed description of those elements having the same configuration as the LCD device according to the third embodiment will be omitted.

In accordance with the fourth embodiment of the present invention, the timing controller 120 generates polarity control signals POL having a different sequence of logic levels at intervals of 4 frames, and supplies the generated polarity control signals POL to the data driving circuit 130. That is, as shown in FIG. 14, the timing controller 20 supplies a first polarity control signal POLa to the data driving circuit 130, for a "4i+1"th frame. The first polarity control signal POLa has a level that inverts between a high level H and a low level L or between a low level L and a high level H at intervals of one horizontal period (one horizontal line). For a "4i+2"th frame, the timing controller 120 supplies a second polarity control signal POLb to the data driving circuit 130. The second polarity control signal POLb has a level inverted in a first horizontal period, and then inverted between a high level H and a low level L at intervals of two horizontal periods (two horizontal lines). For a "4i+3"th frame, the timing controller 20 supplies a third polarity control signal POLc to the data driving circuit 30. The third polarity control signal POLc has a waveform inverted from that of the first polarity control signal POLa. For a "4i+4"th frame, the timing controller 20 supplies a fourth polarity control signal POLd to the data driving circuit 30. The fourth polarity control signal POLd has a waveform inverted from that of the second polarity control signal POLb.

FIGS. 15A to 15D are views showing the polarity patterns of data voltages supplied to the LCD panel for different frames in an LCD device driving method according to a fourth embodiment of the present invention, respectively.

As in the third embodiment of the present invention, in the LCD device driving method according to the fourth embodiment of the present invention, the LCD panel includes first liquid crystal cell groups, to which data voltages having polarities inverted from those of a just-previous frame period are supplied, and second liquid crystal cell groups, to which data voltages having the same polarities as those of the just-previous frame period are supplied, and in that the first and second liquid crystal cell groups are alternately arranged in a vertical direction at intervals of two horizontal lines, and are reversed in position at intervals of one frame period.

Figure 15A:
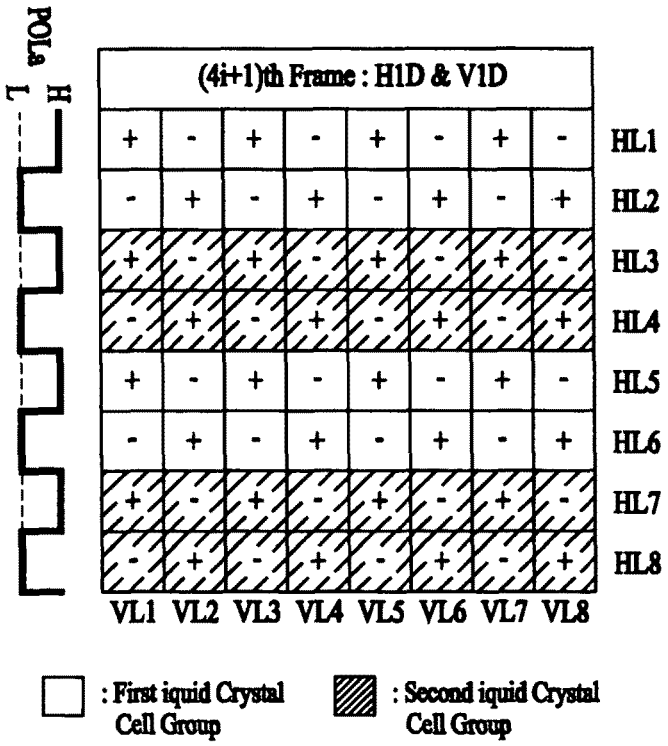
FIGS. 15A to 15D are views showing the polarity patterns of data voltages supplied to an LCD panel for different frames in accordance with the fourth embodiment of the present invention, respectively.

In detail, in a "4i+1"th frame period, as shown in FIG. 15A, the liquid crystal cells are driven in the same manner as that of the first embodiment shown in FIG. 13A. Accordingly, no further description will be given. Thus, for the "4i+1"th frame period, the first and second liquid crystal cell groups are driven in accordance with a horizontal 1-dot inversion (H1D) and vertical 1-dot inversion (V1D) scheme.

Figure 15B:
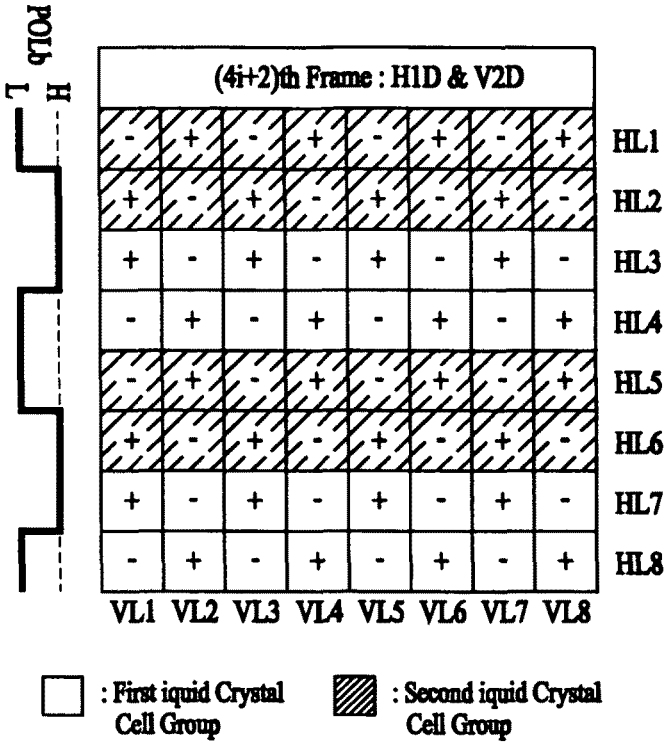

In a "4i+2"th frame period, as shown in FIG. 15B, the liquid crystal cells are driven in the same manner as that of the third embodiment shown in FIG. 13C. Accordingly, no further description will be given. Thus, for the "4i+2"th frame period, the first and second liquid crystal cell groups are driven in accordance with a horizontal 1-dot inversion (H1D) and vertical 2-dot inversion (V2D) scheme. Also, for the "4i+2"th frame period, the first liquid crystal cell groups are changed to the second liquid crystal cell groups, and the second liquid crystal cell groups are changed to the first liquid crystal cell groups, to reverse the positions of the first and second liquid crystal cell groups to each other.

Figure 15C:
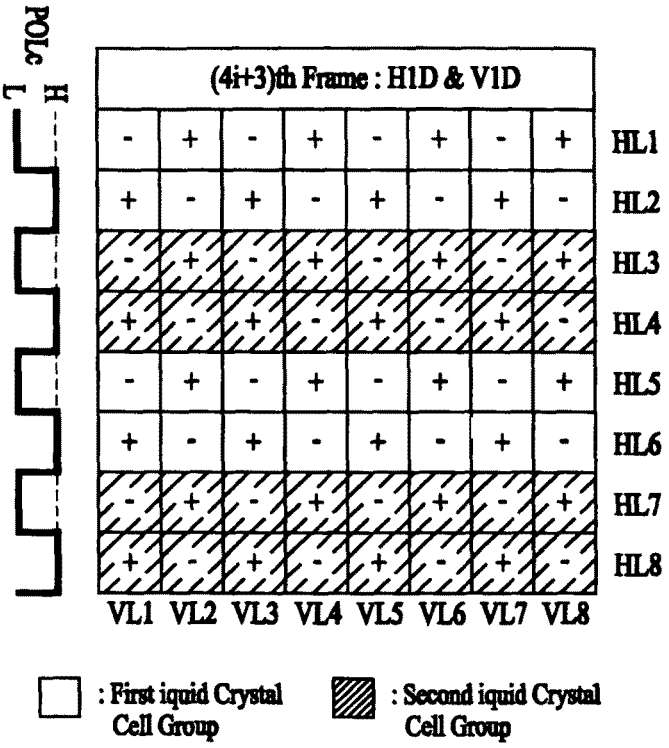

The polarity pattern of the data voltages supplied in a "4i+3"th frame period is opposite to that of the "4i+1"th frame period, as shown in FIG. 15C. Thus, for the "4i+3"th frame period, the first and second liquid crystal cell groups are driven in accordance with a horizontal 1-dot inversion (H1D) and vertical 1-dot inversion (V1D) scheme. Also, for the "4i+3"th frame period, the first liquid crystal cell groups are changed to the second liquid crystal cell groups, and the second liquid crystal cell groups are changed to the first liquid crystal cell groups, to reverse the positions of the first and second liquid crystal cell groups to each other such that the polarity pattern in the "4i+3"th frame period is identical to that in the "4i+1"th frame period.

Figure 15D:
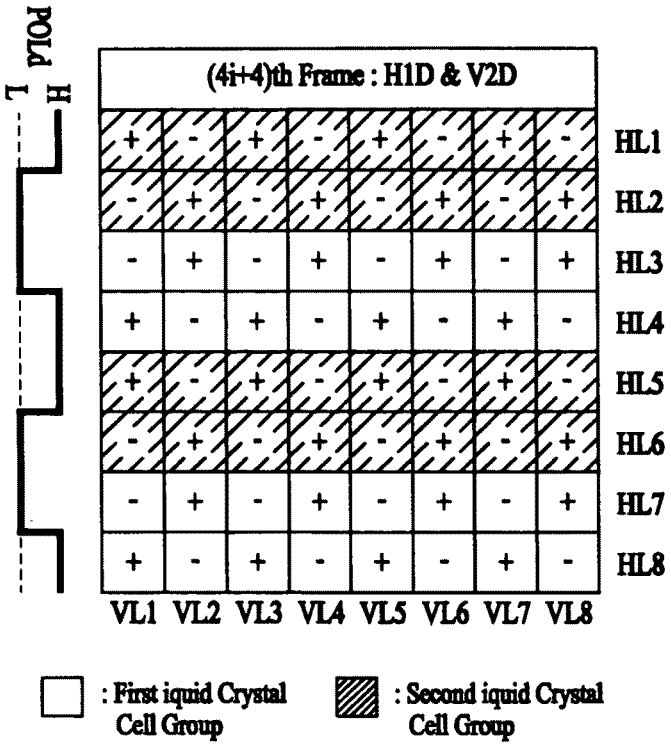

The polarity pattern of the data voltages supplied in a "4i+4"th frame period is opposite to that of the "4i+2"th frame period, as shown in FIG. 15D. Thus, for the "4i+4"th frame period, the first and second liquid crystal cell groups are driven in accordance with a horizontal 1-dot inversion (H1D) and vertical 2-dot inversion (V1D) scheme. Also, for the "4i+4"th frame period, the first liquid crystal cell groups are changed to the second liquid crystal cell groups, and the second liquid crystal cell groups are changed to the first liquid crystal cell groups, to reverse the positions of the first and second liquid crystal cell groups to each other such that the polarity pattern in the "4i+4"th frame period is identical to that in the "4i+2"th frame period.

Thus, as shown in FIGS. 15A to 15D, the LCD device and control method thereof according to the fourth embodiment of the present invention change the first liquid crystal cell groups to the second liquid crystal cell groups while changing the second liquid crystal cell groups to the first liquid crystal cell groups, at intervals of one frame, such that the driving frequency of the data voltages supplied to the second liquid crystal cell group is controlled to be low, in order to prevent DC image sticking, and the driving frequency of the data voltage supplied to the first liquid crystal cell group is controlled to be high, in order to prevent flicker. Thus, it is possible to achieve an enhancement in display quality.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device comprising:

a liquid crystal display panel having a plurality of data lines supplied with data voltages, a plurality of gate lines supplied with scan pulses, wherein a plurality of liquid crystal cells on the liquid crystal display panel are each configured to display one of a plurality of colors, wherein liquid crystal cells arranged in a horizontal line along a gate line direction are configured to display a common color, and wherein liquid crystal cells arranged in each column along a direction of the data lines are arranged to display a repeating sequence of the plurality of colors;

a timing controller for generating a polarity control signal having a sequence of polarity levels that vary at intervals of one frame period;

a data driving circuit for supplying the data voltages to the data lines having a polarity in response to the polarity control signal; and a gate driving circuit for supplying the scan pulses to the gate lines, wherein the liquid crystal cells are coupled to the data lines and gate lines to receive the data voltages and the gate pulses so that the liquid crystal cells of the liquid crystal display panel are driven in groups, the groups including first liquid crystal cell groups driven so that the data voltages in a frame period have polarities inverted from polarities in an immediately prior frame period, and second liquid crystal cell groups driven so that the data voltages in a frame period have polarities identical to the polarities in an immediately prior frame period, and the first and second liquid crystal cell groups are alternately arranged in a vertical direction at intervals of two horizontal lines, and wherein the positions of the first liquid crystal cell groups alternate with the positions of the second liquid crystal cell groups at intervals of one frame period, wherein each of the first and second liquid crystal cell groups has cells of two adjacent horizontal lines, wherein the polarity control signal comprises:

a first polarity control signal sequence generated for a "4i+1"th frame, the first polarity control signal sequence having a level alternating between a first level and a second level at intervals of two horizontal lines, wherein "i" is a positive integer;

a second polarity control signal sequence generated for a "4i+2"th frame, the second polarity control signal sequence having a level maintained at one of the first and second levels;

a third polarity control signal sequence generated for a "4i+3"th frame, the third polarity control signal sequence having a sequence of levels inverted from the sequence of levels of the first polarity control signal sequence; and a fourth polarity control signal sequence generated for a "4i+4"th frame, the fourth polarity control signal sequence having a level sequence inverted from the sequence of levels of the second polarity control signal sequence.

2. The liquid crystal display device according to claim 1, wherein the first liquid crystal groups are driven at a data driving frequency higher than a data driving frequency at which the second liquid crystal groups are driven.

3. The liquid crystal display device according to claim 2, wherein:

each of the liquid crystal cells includes a thin film transistor, and a pixel electrode coupled to the thin film transistor;

the thin film transistors of adjacent liquid crystal cells arranged along the data line direction are coupled to alternating ones of two data lines arranged adjacent to and at opposite sides of the adjacent liquid crystal cells; and the thin film transistors of pairs of the liquid crystal cells arranged adjacent to each other in a vertical direction and on opposite sides of each gate line are coupled to the respective gate line to receive scan pulses supplied to the respective gate line.

4. The liquid crystal display device according to claim 3, wherein:

the thin film transistors of the liquid crystal cells arranged in each odd one of horizontal lines extending in a direction corresponding to the gate line direction are coupled to one of the gate lines, and are coupled to respective odd numbered ones of the data lines; and the thin film transistors of the liquid crystal cells arranged in each even one of the horizontal lines extending in a direction corresponding to the gate line direction are coupled to one of the gate lines, and are coupled to respective even numbered ones of the data lines.

5. The liquid crystal display device according to claim 4, wherein the data driving circuit includes a plurality of output channels that supply the data voltages to respective data lines through respective ones of the output channels after inverting the polarities of the data voltages at intervals of two adjacent output channels after outputting the data voltage corresponding to a first output channel.

6. The liquid crystal display device according to claim 1, wherein:

for the "4i+1"th frame period, the first liquid crystal cell groups comprise the liquid crystal cells arranged on "4i+1"th and "4i+2"th horizontal lines, and the second liquid crystal cell groups comprise the liquid crystal cells arranged on "4i+3"th and "4i+4"th horizontal lines between adjacent ones of the first liquid crystal cell groups;

for the "4i+2"th frame period, the second liquid crystal cell groups comprise the liquid crystal cells arranged on the "4i+1"th and "4i+2"th horizontal lines, and the first liquid crystal cell groups comprise the liquid crystal cells arranged on the "4i+3"th and "4i+4"th horizontal lines between adjacent ones of the second liquid crystal cell groups;

for the "4i+3"th frame period, the first liquid crystal cell groups comprise the liquid crystal cells arranged on the "4i+1"th and "4i+2"th horizontal lines, and the second liquid crystal cell groups comprise the liquid crystal cells arranged on the "4i+3"th and "4i+4"th horizontal lines between adjacent ones of the first liquid crystal cell groups; and for the "4i+4"th frame period, the second liquid crystal cell groups comprise the liquid crystal cells arranged on the "4i+1"th and "4i+2"th horizontal lines, and the first liquid crystal cell groups comprise the liquid crystal cells arranged on the "4i+3"th and "4i+4"th horizontal lines between adjacent ones of the second liquid crystal cell groups.

7. A liquid crystal display device comprising:

a liquid crystal display panel having a plurality of data lines supplied with data voltages, a plurality of gate lines supplied with scan pulses, wherein a plurality of liquid crystal cells on the liquid crystal display panel are each configured to display one of a plurality of colors, wherein liquid crystal cells arranged in a horizontal line along a gate line direction are configured to display a common color, and wherein liquid crystal cells arranged in each column along a direction of the data lines are arranged to display a repeating sequence of the plurality of colors;

a timing controller for generating a polarity control signal having a sequence of polarity levels that vary at intervals of one frame period;

a data driving circuit for supplying the data voltages to the data lines having a polarity in response to the polarity control signal; and a gate driving circuit for supplying the scan pulses to the gate lines, wherein the liquid crystal cells are coupled to the data lines and gate lines to receive the data voltages and the gate pulses so that the liquid crystal cells of the liquid crystal display panel are driven in groups, the groups including first liquid crystal cell groups driven so that the data voltages in a frame period have polarities inverted from polarities in an immediately prior frame period, and second liquid crystal cell groups driven so that the data voltages in a frame period have polarities identical to the polarities in an immediately prior frame period, and the first and second liquid crystal cell groups are alternately arranged in a vertical direction at intervals of two horizontal lines, and wherein the positions of the first liquid crystal cell groups alternate with the positions of the second liquid crystal cell groups at intervals of one frame period, wherein each of the first and second liquid crystal cell groups has cells of two adjacent horizontal lines, wherein the polarity control signal comprises:

a first polarity control signal sequence generated for a "4i+1"th frame, the first polarity control signal sequence having a level alternating between a first level and a second level at intervals of one horizontal line, wherein "i" is a positive integer;

a second polarity control signal sequence generated for a "4i+2"th frame, the second polarity control signal sequence having a level inverted for a first horizontal line, and then inverted between the first level and the second level at intervals of two horizontal lines;

a third polarity control signal sequence generated for a "4i+3"th frame, the third polarity control signal sequence having a level inverted from the level of the first polarity control signal sequence; and a fourth polarity control signal sequence generated for a "4i+4"th frame, the fourth polarity control signal sequence having a level inverted from the level of the second polarity control signal sequence.

8. The liquid crystal display device according to claim 7, wherein:

each of the liquid crystal cells comprises a thin film transistor, and a pixel electrode coupled to the thin film transistor;

the thin film transistors of the liquid crystal cells arranged in each column along the data line direction are coupled to a common data line arranged adjacent to the liquid crystal cells arranged in the respective column; and the thin film transistors of the liquid crystal cells arranged in a horizontal line along the gate line direction are coupled to a common one of the gate lines adjacent to the liquid crystal cells arranged in the horizontal line.

9. The liquid crystal display device according to claim 8, wherein the data driving circuit includes a plurality of output channels to supply the data voltages to each of the data lines through a respective one of the output channels after inverting the polarities of the data voltages at intervals of one output channel.

10. The liquid crystal display device according to claim 7, wherein:

for the "4i+1"th frame period, the first liquid crystal cell groups comprise the liquid crystal cells arranged on "4i+1"th and "4i+2"th horizontal lines, and the second liquid crystal cell groups comprise the liquid crystal cells arranged on "4i+3"th and "4i+4"th horizontal lines between adjacent ones of the first liquid crystal cell groups;

for the "4i+2"th frame period, the second liquid crystal cell groups comprise the liquid crystal cells arranged on the "4i+1"th and "4i+2"th horizontal lines, and the first liquid crystal cell groups comprise the liquid crystal cells arranged on the "4i+3"th and "4i+4"th horizontal lines between adjacent ones of the second liquid crystal cell groups;

for the "4i+3"th frame period, the first liquid crystal cell groups comprise the liquid crystal cells arranged on the "4i+1"th and "4i+2"th horizontal lines, and the second liquid crystal cell groups comprise the liquid crystal cells arranged on the "4i+3"th and "4i+4"th horizontal lines between adjacent ones of the first liquid crystal cell groups; and for the "4i+4"th frame period, the second liquid crystal cell groups comprise the liquid crystal cells arranged on the "4i+1"th and "4i+2"th horizontal lines, and the first liquid crystal cell groups comprise the liquid crystal cells arranged on the "4i+3"th and "4i+4"th horizontal lines between adjacent ones of the second liquid crystal cell groups.

11. A method for driving a liquid crystal display device including a liquid crystal display panel formed with a plurality of data lines, to which data voltages are supplied, and a plurality of gate lines, to which scan pulses are supplied, the liquid crystal display panel having a plurality of liquid crystal cells each configured to display one of a plurality of colors, wherein liquid crystal cells arranged in a horizontal line along a gate line direction are configured to display a common color and wherein liquid crystal cells arranged in each column along a direction of the data lines are arranged to display a repeating sequence of the plurality of colors, the method comprising:

generating a polarity control signal such that the polarity control signal has a sequence of polarity levels that vary at intervals of one frame period;

supplying the scan pulses to the gate lines; and supplying data voltages to the liquid crystal cells using the data lines including:

supplying the data voltages in a frame period, which have polarities inverted from polarities in an immediately previous frame period, to first liquid crystal cell groups of the liquid crystal cells; and supplying the data voltages in the frame period, which have polarities identical to the polarities in the immediately previous frame period, to second liquid crystal cell groups of the liquid crystal cells in a simultaneous manner, in response to the polarity control signal, wherein the first and second liquid crystal cell groups are alternately arranged in a vertical direction at intervals of two horizontal lines, and wherein the positions of the first liquid crystal cell groups alternate with the positions of the second liquid crystal cell groups at intervals of one frame period, wherein each of the first and second liquid crystal cell groups has cells of two adjacent horizontal lines, wherein generating a polarity control signal includes:

generating a first polarity control signal sequence generated for a "4i+1"th frame, the first polarity control signal sequence having a level inverted between a first level and a second level at intervals of two horizontal lines, wherein "i" is a positive integer;

generating a second polarity control signal sequence generated for a "4i+2"th frame, the second polarity control signal sequence having a level maintained at one of the first and second levels;

generating a third polarity control signal sequence generated for a "4i+3"th frame, the third polarity control signal sequence having a level inverted from the level of the first polarity control signal sequence; and generating a fourth polarity control signal sequence generated for a "4i+4"th frame, the fourth polarity control signal sequence having a level inverted from the level of the second polarity control signal sequence.

12. The method according to claim 11, wherein the first liquid crystal groups are driven at a data driving frequency higher than a data driving frequency at which the second liquid crystal groups are driven.

13. The method according to claim 12, wherein the liquid crystal cells arranged adjacent to each other in a vertical direction and at opposite sides of one gate line are simultaneously driven by scan pulses on the one gate line, and are respectively supplied with the data voltages from different adjacent data lines.

14. The method according to claim 13, wherein supplying data voltages to the liquid crystal cells using the data lines further includes:

inverting the polarities of the data voltages respectively supplied to the data lines at intervals of adjacent two data lines, except for the data voltage supplied to a first one of the data lines.

15. The method according to claim 11, wherein:

for the "4i+1"th frame period, the first liquid crystal cell groups comprise the liquid crystal cells arranged on "4i+1"th and "4i+2"th horizontal lines, and the second liquid crystal cell groups comprise the liquid crystal cells arranged on "4i+3"th and "4i+4"th horizontal lines between adjacent ones of the first liquid crystal cell groups;

for the "4i+2"th frame period, the second liquid crystal cell groups comprise the liquid crystal cells arranged on the "4i+1"th and "4i+2"th horizontal lines, and the first liquid crystal cell groups comprise the liquid crystal cells arranged on the "4i+3"th and "4i+4"th horizontal lines between adjacent ones of the second liquid crystal cell groups;

for the "4i+3"th frame period, the first liquid crystal cell groups comprise the liquid crystal cells arranged on the "4i+1"th and "4i+2"th horizontal lines, and the second liquid crystal cell groups comprise the liquid crystal cells arranged on the "4i+3"th and "4i+4"th horizontal lines between adjacent ones of the first liquid crystal cell groups; and for the "4i+4"th frame period, the second liquid crystal cell groups comprise the liquid crystal cells arranged on the "4i+1"th and "4i+2"th horizontal lines, and the first liquid crystal cell groups comprise the liquid crystal cells arranged on the "4i+3"th and "4i+4"th horizontal lines between adjacent ones of the second liquid crystal cell groups.

16. A method for driving a liquid crystal display device including a liquid crystal display panel formed with a plurality of data lines, to which data voltages are supplied, and a plurality of gate lines, to which scan pulses are supplied, the liquid crystal display panel having a plurality of liquid crystal cells each configured to display one of a plurality of colors, wherein liquid crystal cells arranged in a horizontal line along a gate line direction are configured to display a common color and wherein liquid crystal cells arranged in each column along a direction of the data lines are arranged to display a repeating sequence of the plurality of colors, the method comprising:

generating a polarity control signal such that the polarity control signal has a sequence of polarity levels that vary at intervals of one frame period;

supplying the scan pulses to the gate lines; and supplying data voltages to the liquid crystal cells using the data lines including:

supplying the data voltages in a frame period, which have polarities inverted from polarities in an immediately previous frame period, to first liquid crystal cell groups of the liquid crystal cells; and supplying the data voltages in the frame period, which have polarities identical to the polarities in the immediately previous frame period, to second liquid crystal cell groups of the liquid crystal cells in a simultaneous manner, in response to the polarity control signal, wherein the first and second liquid crystal cell groups are alternately arranged in a vertical direction at intervals of two horizontal lines, and wherein the positions of the first liquid crystal cell groups alternate with the positions of the second liquid crystal cell groups at intervals of one frame period, wherein each of the first and second liquid crystal cell groups has cells of two adjacent horizontal lines, wherein generating a polarity control signal further includes:

generating a first polarity control signal sequence generated for a "4i+1"th frame, the first polarity control signal sequence having a level inverted between a first level and a second level at intervals of one horizontal line, wherein "i" is a positive integer;

generating a second polarity control signal sequence generated for a "4i+2"th frame, the second polarity control signal sequence having a level inverted for a first horizontal line, and then inverted between the first level and the second level at intervals of two horizontal lines;

generating a third polarity control signal sequence generated for a "4i+3"th frame, the third polarity control signal sequence having a level inverted from the level of the first polarity control signal sequence; and generating a fourth polarity control signal sequence generated for a "4i+4"th frame, the fourth polarity control signal sequence having a level inverted from the level of the second polarity control signal sequence.

17. The method according to claim 16, wherein each of the liquid crystal cells is supplied with the data voltage from one data line arranged adjacent to the liquid crystal cell in accordance with a driving operation of one gate line arranged adjacent to the liquid crystal cell.

18. The method according to claim 17, wherein supplying data voltages to the liquid crystal cells using the data lines includes alternating the polarities of the data voltages respectively supplied to the data lines at intervals of one data line.

19. The method according to claim 16, wherein:

for the "4i+1"th frame period, the first liquid crystal cell groups comprise the liquid crystal cells arranged on "4i+1"th and "4i+2"th horizontal lines, and the second liquid crystal cell groups comprise the liquid crystal cells arranged on "4i+3"th and "4i+4"th horizontal lines between adjacent ones of the first liquid crystal cell groups;

for the "4i+2"th frame period, the second liquid crystal cell groups comprise the liquid crystal cells arranged on the "4i+1"th and "4i+2"th horizontal lines, and the first liquid crystal cell groups comprise the liquid crystal cells arranged on the "4i+3"th and "4i+4"th horizontal lines between adjacent ones of the second liquid crystal cell groups;

for the "4i+3"th frame period, the first liquid crystal cell groups comprise the liquid crystal cells arranged on the "4i+1"th and "4i+2"th horizontal lines, and the second liquid crystal cell groups comprise the liquid crystal cells arranged on the "4i+3"th and "4i+4"th horizontal lines between adjacent ones of the first liquid crystal cell groups; and for the "4i+4"th frame period, the second liquid crystal cell groups comprise the liquid crystal cells arranged on the "4i+1"th and "4i+2"th horizontal lines, and the first liquid crystal cell groups comprise the liquid crystal cells arranged on the "4i+3"th and "4i+4"th horizontal lines between adjacent ones of the second liquid crystal cell groups.

* * * * *